US006573668B1

(12) United States Patent
Tagami

(10) Patent No.: US 6,573,668 B1
(45) Date of Patent: Jun. 3, 2003

(54) COLOR CATHODE RAY TUBE HAVING A CONVERGENCE CORRECTION APPARATUS

(75) Inventor: Etsuji Tagami, Takatsuki (JP)

(73) Assignee: Matsushita Electric Ind., Co., Ltd., Osaka (JP)

( * ) Notice: Subject to any disclaimer, the term of this patent is extended or adjusted under 35 U.S.C. 154(b) by 141 days.

(21) Appl. No.: 09/669,175

(22) Filed: Sep. 25, 2000

(30) Foreign Application Priority Data

Oct. 1, 1999 (JP) ..... 11-281322

(51) Int. Cl.[7] ..... H01F 1/00; H01F 3/12

(52) U.S. Cl. ..... 315/368.28; 315/364; 315/440

(58) Field of Search ..... 313/440, 431, 313/442, 412, 413; 315/364, 368.28, 368.27, 365, 366; 335/211, 210, 214, 213

(56) References Cited

U.S. PATENT DOCUMENTS 4,257,023 A * 3/1981 Kamijo ..... 335/210
4,433,268 A * 2/1984 Arisato ..... 313/440
4,746,837 A * 5/1988 Vink ..... 313/431
4,823,100 A * 4/1989 Bruey ..... 313/421
5,041,764 A * 8/1991 Midland et al. ..... 315/368.12
5,121,028 A * 6/1992 Milili ..... 313/440
5,327,051 A * 7/1994 Johnson et al. ..... 315/368.28
5,455,483 A * 10/1995 Azzi et al. ..... 313/431
5,777,429 A * 7/1998 Headley ..... 313/440
5,847,503 A * 12/1998 Roussel et al. ..... 313/426
6,380,699 B2 * 4/2002 Miyazaki et al. ..... 315/368.28

FOREIGN PATENT DOCUMENTS

JP 9098193 4/1996

* cited by examiner

*Primary Examiner*—Don Wong
*Assistant Examiner*—Chuc D Tran

(57) ABSTRACT

A color cathode ray tube using a self-convergence method is provided with magnets for correcting top/bottom pincushion distortion, and includes a vertical deflection coil and a four-pole coil. The vertical deflection coil generates a first correction field distorted in a barrel shape. The four-pole coil is arranged on the side of a deflection yoke nearer to an electron gun, and corrects YH barrel pattern misconvergence by generating a second correction field. The strength of the second correction field varies according to the amount of vertical deflection applied to electron beams emitted by the electron gun.

20 Claims, 26 Drawing Sheets

COLOR CATHODE RAY TUBE HAVING A CONVERGENCE CORRECTION APPARATUS

This application is based on an application No. 11-281322 filed in Japan, the content of which is hereby incorporated by reference.

BACKGROUND OF THE INVENTION

1. Field of the Invention

The present invention relates to a color cathode ray tube used in television sets, computer displays and the like, and in particular to an apparatus for correcting convergence in a color cathode ray tube (hereafter CRT) that corrects raster distortion using magnets.

2. Related Art

One method used to correct convergence in a color CRT that uses an inline electron gun is a self-convergence method. This method corrects convergence involving pincushion distortion of the horizontal deflection field and barrel distortion of the vertical deflection field. The self-convergence method enables apparatuses with a simple construction and an excellent cost-performance ratio to be manufactured, and is consequently in widespread use.

In a conventional color CRT using the self-convergence method, for example a color CRT with a deflection angle of 90°, and a large screen curvature, the vertical deflection field experiences barrel distortion, thereby causing the horizontal component (hereafter referred to as 'Bh') of the vertical deflection field to become larger nearer to the right and left edges of the CRT. FIG. 1A is a graph plotting Bh against a horizontal axis H of the CRT. If a central point along the horizontal direction of the CRT is taken as an origin O, line 1 showing Bh is symmetrical about the origin O, and slopes upward more steeply the further it is from the origin O.

According to Fleming's Law, the vertical deflection force applied to the electron beams will increase as Bh becomes larger. Therefore, in a color CRT using the self-convergence method, electron beams passing closer to a vertical axis V will receive a weaker vertical deflection, and electron beams passing further away from the vertical axis V will receive a stronger vertical deflection. When an inline electron gun is used, three electron beams corresponding to the three colors RGB (red, green and blue) are horizontally aligned, so that, if we ignore a case in which the central beam of the three electron beams coincides with the vertical axis V, there will be some variations in the vertical deflection force applied to electron beams on either side of the vertical axis V. FIG. 1B shows vertical deflection forces Fr, Fg and Fb, received respectively by the red, green and blue electron beams R, G and B. Electron beams emitted by an inline electron gun are usually arranged in the order B, G and R from left to right as seen from in front of the screen. In this specification, it is assumed that all electron beams are arranged in this order. When the electron beam G coincides with the vertical axis V, in other words when it is positioned so as to correspond to the origin O of the horizontal axis H, vertical deflection forces Fr and Fb are equal, and vertical deflection force Fg is smaller than both vertical deflection forces Fr and Fb. When the electron beam R is further away from the origin O than the electron beam B, however, the vertical deflection forces received by the electron beams are such that $Fb<Fg<Fr$. Conversely, when the electron beam B is further away from the origin O than the electron beam R, the vertical deflection forces received are such that $Fb>Fg>Fr$.

As a result, when horizontal magenta lines are displayed at the top and bottom edges of the screen, the misconvergence shown in FIG. 2 is caused. Here, a red component R (the solid line in the drawing) and a blue component B (the broken line in the drawing) in each magenta line on a display screen 2, diverge vertically towards the corners of the screen. Since Bh is largest when the amount of vertical deflection reaches its maximum, this misconvergence is particularly marked at the corner areas of the screen. This type of misconvergence is hereafter referred to as PQV pincushion pattern misconvergence.

Japanese Laid Open Patent 8-98193 discloses a color CRT that corrects PQV pincushion pattern misconvergence by weakening the barrel distortion of the vertical deflection field. FIG. 3A is a graph plotting the values of Bh, both before and after barrel distortion of the vertical deflection field has been weakened, against the horizontal axis H. As a result of weakening barrel distortion, the variation in Bh changes from line 1 to line 3 in the drawing. Thus, as shown in FIG. 3B, the variations in Bh along the horizontal are reduced, and PQV pincushion pattern misconvergence is corrected.

If the barrel distortion of the vertical deflection field is weakened, this in turn weakens the ability of the CRT to correct misconvergence using a self-convergence method. Here, if a magenta line is displayed vertically down the center of the display screen 2, the misconvergence shown in FIG. 4 will be generated. This misconvergence is hereafter referred to as YH pincushion pattern misconvergence. The color CRT disclosed in the related art corrects this type of misconvergence using a four-pole coil. FIG. 5 is a view of such a four-pole coil, seen from the front of the screen. Here, a four-pole coil 4 includes coils 5 and 8, and U-shaped cores 6 and 7. The U-shaped cores 6 and 7 are arranged in opposition on the side of the deflection yoke nearer to the electron gun, so that the electron beams pass between the two cores 6 and 7. When a vertical deflection current is passed through the coils 5 and 8 after being rectified by a diode, force is exerted on the electron beams B and R emitted from the left and right of the electron gun, pushing them away from the vertical axis V, and thereby correcting YH pincushion pattern misconvergence.

In recent years, color CRTs with a virtually flat screen and a wide deflection angle have become increasing commonplace. In such CRTs, the distance the electron beams travel to reach the screen after being emitted from the electron gun varies markedly for each point on the screen surface. This results in increased raster distortion. Of this raster distortion, that which occurs when the top and bottom edges of the raster area scanned by the electron beams bow inward is referred to as top/bottom pincushion distortion, and is conventionally corrected by attaching magnets to the deflection yoke. FIG. 6 is a view of a deflection yoke to which magnets have been attached, seen from in front of the display screen. Magnets 10 and 13 are attached to the front surface of an insulating frame 11 of a deflection yoke 9 at the top and bottom, and a horizontal deflection coil 12 is mounted on the inner surface of the insulating frame 11. When viewed from in front of the display screen, the magnets 10 and 13 are arranged so that the north pole of the magnet 10 is on the right side and the south pole on the left side, while the south pole of the magnet 13 is on the right side and the north pole on the left side. FIG. 7 illustrates magnetic flux generated by the magnets 10 and 13. If the magnets 10 and 13 are arranged in this fashion, forces F are applied to the electron beams according to Fleming's Law, as shown in FIG. 7, thereby correcting the top/bottom pincushion distortion.

However, a horizontal component Mh of the magnetic fields generated by the magnets 10 and 13 grows weaker at points further away from the magnets. FIG. 8A is a graph plotting Mh against the horizontal axis H. If a point at the center of the horizontal axis H is taken as an origin O, line 14 showing component Mh is symmetrical about the origin O, growing smaller and sloping down more steeply as it moves further away from the origin O. FIG. 8B shows forces Fr, Fg and Fb received by electron beams R, G and B. When the electron beam G coincides with the vertical axis V, in other words when it is positioned so as to correspond to the origin O of the horizontal axis H, vertical deflection forces Fr and Fb are equal, and vertical deflection force Fg is larger than both vertical deflection forces Fr and Fb. When the electron beam R is further away from the origin O than the electron beam B, however, the vertical deflection forces received by the electron beams are such that Fb>Fg>Fr. Conversely, when the electron beam B is further away from the origin O than the electron beam R, the vertical deflection forces received are such that Fb<Fg<Fr. As a result, when a magenta line is displayed horizontally, the misconvergence shown in FIG. 9 is caused. In this type of misconvergence, the red component R (solid line) and the blue component B (broken line) of the magenta line diverge away from each other. This is known as PQV barrel pattern misconvergence.

Although the magnetic field generated by the magnets 10 and 13 relieves barrel distortion of the vertical deflection field, this in turn causes YH pincushion misconvergence to worsen. This misconvergence is so severe that correcting it using a four-pole coil as in the related art increases PQH red right pattern misconvergence. FIG. 10 shows PQH red right pattern misconvergence. In this type of misconvergence, when two magenta lines are displayed vertically on the left and right sides of the display screen, as shown in the drawing, the red component R (solid line) of the magenta line veers to the right and the blue component B (broken line) to the left. Components R and B tend to diverge markedly towards the corners of the display screen. Note that in the drawing, D1 is a distance at which the red component R and the blue component B are furthest apart, and the severity of PQH red right pattern misconvergence can be expressed using this distance D1.

SUMMARY OF THE INVENTION

An object of the invention is to provide a color CRT of the type that has become popular in recent years, with a virtually flat screen and a wide deflection angle, and in particular, to provide a color CRT with superior picture quality, that corrects convergence by correcting pincushion distortion at the top and bottom of the raster area using magnets.

The color CRT of the invention has the following structure in order to achieve the above object. A color cathode ray tube (CRT) uses a self-convergence method, has magnets for correcting top/bottom pincushion distortion, and includes the following. A vertical deflection coil generates a first correction field distorted in a barrel shape. A four-pole coil is arranged on a side of a deflection yoke nearer to an electron gun, and generates a second correction field to correct YH barrel pattern misconvergence. Here, the strength of the second correction field varies according to an amount of vertical deflection applied to electron beams emitted by the electron gun.

If the above structure is used, PQV barrel pattern misconvergence generated by magnets can be corrected. YH pincushion pattern misconvergence, which could not be corrected in the related art, is over-corrected to YH barrel pattern misconvergence, and this misconvergence can then be corrected by the four-pole coil. At the same time, PQH red right pattern misconvergence generated when the vertical deflection field is distorted in a barrel shape can also be corrected.

The following structure may be used in order to distort the vertical deflection field in a barrel shape. The vertical deflection coil includes a first coil part and a second coil part connected in series. The first coil part has coil sections with a larger winding angle than a winding angle of coil sections in the second coil part. The first and second coil parts are connected in parallel respectively to first and second impedance elements, and the first correction field may be distorted in the barrel shape by making an impedance of the second impedance element larger than an impedance of the first impedance element. Alternatively, the first correction field may be distorted in the barrel shape by having a greater number of turns in the second coil part than in the first coil part.

Furthermore, the four-pole coil should preferably have the following structure. Three horizontally aligned electron beams are emitted by the electron gun. Here, the second correction field may be generated by the four-pole coil so as to apply an inward horizontal force to each outer electron beam of the three horizontally aligned electron beams. The strength of the second correction field applied to the electron beams is at a maximum when the amount of vertical deflection applied to the electron beams is at a maximum, and at a minimum when the amount of vertical deflection experienced by the electron beams is zero. Furthermore, the four-pole coil may be connected to the vertical deflection coil via a peripheral circuit. The peripheral circuit includes a series circuit in which two resistors are connected in series, two diodes each having a cathode connected respectively to either end of the series circuit, and two variable resistors, each connected respectively to an anode of one of the two diodes at one end, and to one end of the four-pole coil at the other end. Here, the other end of the four-pole coil may be connected to a node at which the two resistors in the series circuit are connected, and the series circuit may be connected in series to the vertical deflection coil. In addition, the four-pole coil may include two coils connected in series. Each of these two coils is wound around one of two U-shaped cores. The U-shaped cores are arranged with corresponding ends in opposition, and the electron beams pass between the opposed U-shaped cores.

Furthermore, VCR misconvergence generated when the vertical deflection field is distorted in a barrel shape can be corrected by using the following structure. The CRT may include a coma correction coil, arranged on the side of the deflection yoke nearer to the electron gun, and used to generate a third correction field to correct vertical coma residual (VCR) misconvergence. Here, a strength of the third correction field may vary according to the amount of vertical deflection applied to the electron beams. Furthermore, the force applied to the electron beams by the third correction field may be applied in a same orientation as the vertical deflection. The forces applied to the outer electron beams may be of equal strength, while a force applied to a central electron beam is greater than the forces applied to the outer electron beams. The strength of the third correction field applied to the electron beams is at a maximum when the amount of vertical deflection applied to the electron beams is at a maximum, and at a minimum when the amount of vertical deflection experienced by the electron beams is zero. The coma correction coil may include two coils that are connected in series, and connected in series to the vertical deflection coil. Each of these two coils is wound around one of two U-shaped cores. The two U-shaped cores are arranged in opposition, and the electron beams pass between the two opposed U-shaped cores.

In addition, a structure such as the following may be used. A color cathode ray tube (CRT) uses a self-convergence method, has magnets for correcting top/bottom pincushion distortion, and includes the following. A magnetic substance, which is either one normally or strongly magnetic, may be arranged on the side of the vertical deflection coil nearer to an outer surface of a glass tube to distort a vertical deflection field in a barrel shape. A four-pole coil may be arranged on a side of a deflection yoke nearer to an electron gun to correct YH barrel pattern misconvergence by generating a second correction field. The strength of the second correction field varies according to an amount of vertical deflection applied to electron beams emitted by the electron gun. Even if such a structure is used, the vertical deflection field can still be distorted in a barrel shape, and so misconvergence can be corrected as above, provided that such a structure includes a four-pole coil and a coma correction coil.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The embodiments of the present invention are hereafter described in relation to a 19-inch virtually flat-screened display monitor with a deflection angle of 100° and a 4:3 aspect ratio. This apparatus is hereafter referred to as 'the monitor'.

First Embodiment

The following is an explanation of a monitor 15 in a first embodiment of the invention, with reference to the drawings.

Structure of the Monitor 15

Figure 11:
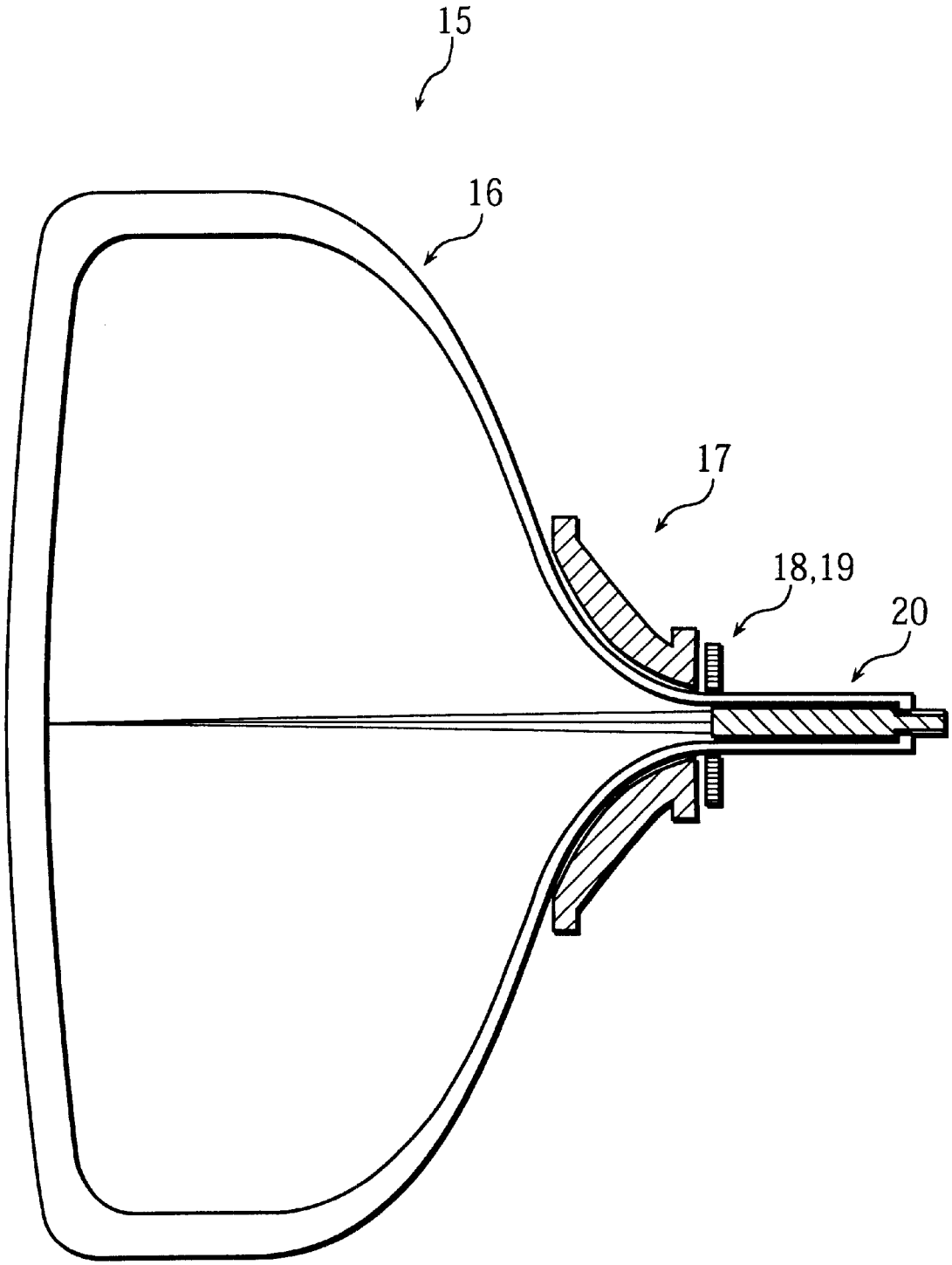
FIG. 11 is a cross-section of a display monitor tube in the embodiments of the invention, on a horizontal plane that includes a tube axis Z.

FIG. 11 is a cross-section, on a horizontal plane including a tube axis Z, of the monitor 15 in this embodiment. In the drawing, the monitor 15 includes a glass tube 16, a deflection yoke 17, and an electron gun 20, and has a four-pole coil 18 and a coma correction coil 19 for correcting misconvergence. Note that the four-pole coil 18 and the coma correction coil 19 share the same cores, as is explained hereafter.

Deflection Yoke 17

Figure 12:
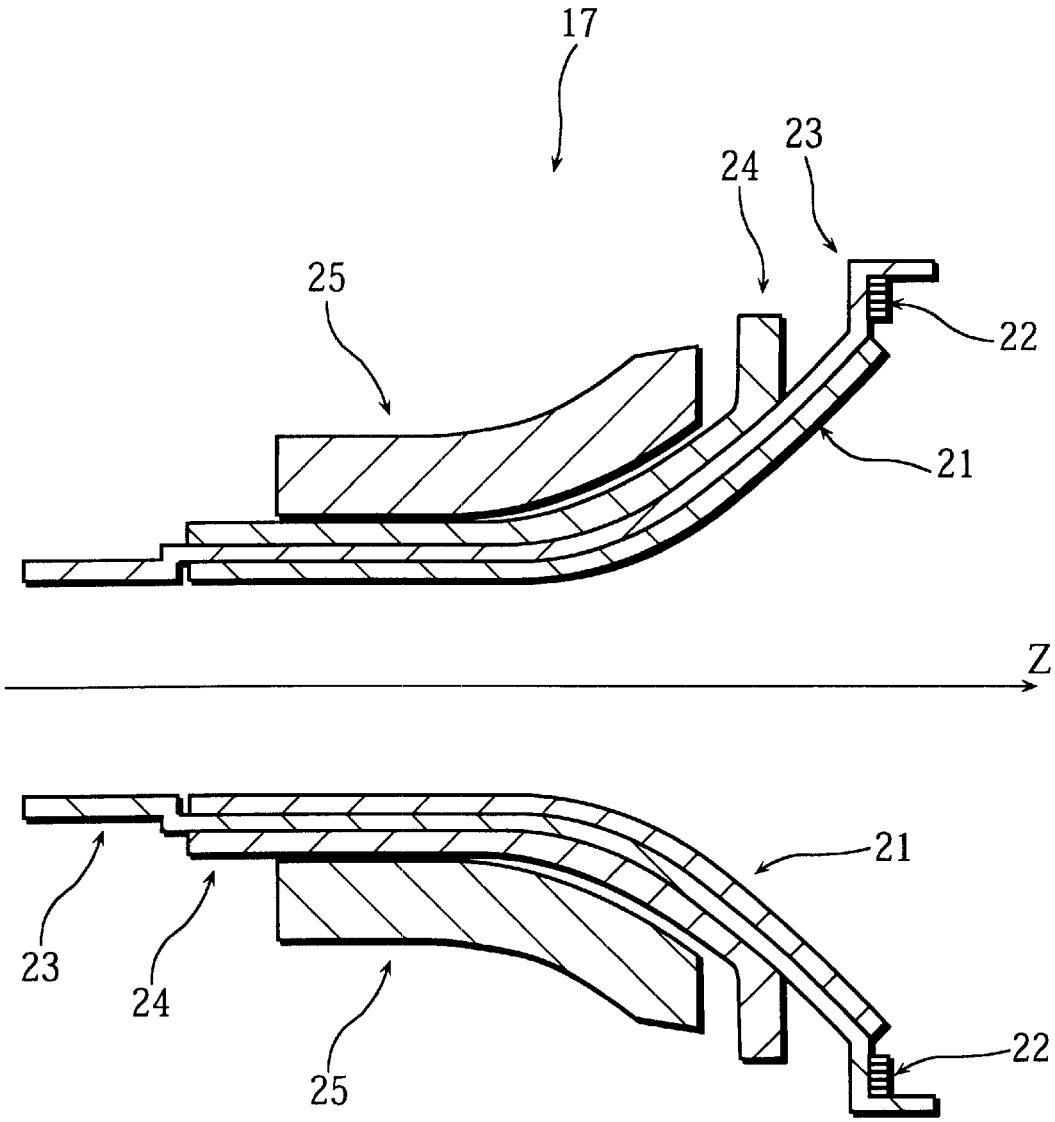
FIG. 12 is a vertical cross-section, including a tube axis Z, of a deflection yoke in a display monitor tube in the embodiments of the invention.

FIG. 12 is a vertical cross-section of the deflection yoke 17, including a tube axis Z. The deflection yoke 17 includes a horizontal deflection coil 21, magnets 22, an insulating frame 23, a vertical deflection coil 24 and a ferrite coil 25. Each magnet 22 is 40.0 mm×10.0 mm×5.0 mm in size, and has a surface magnetic flux density of 0.04 T (Tesla). The magnets 22 are used to correct top/bottom pincushion distortion.

Vertical Deflection Coil 24

Figure 13:
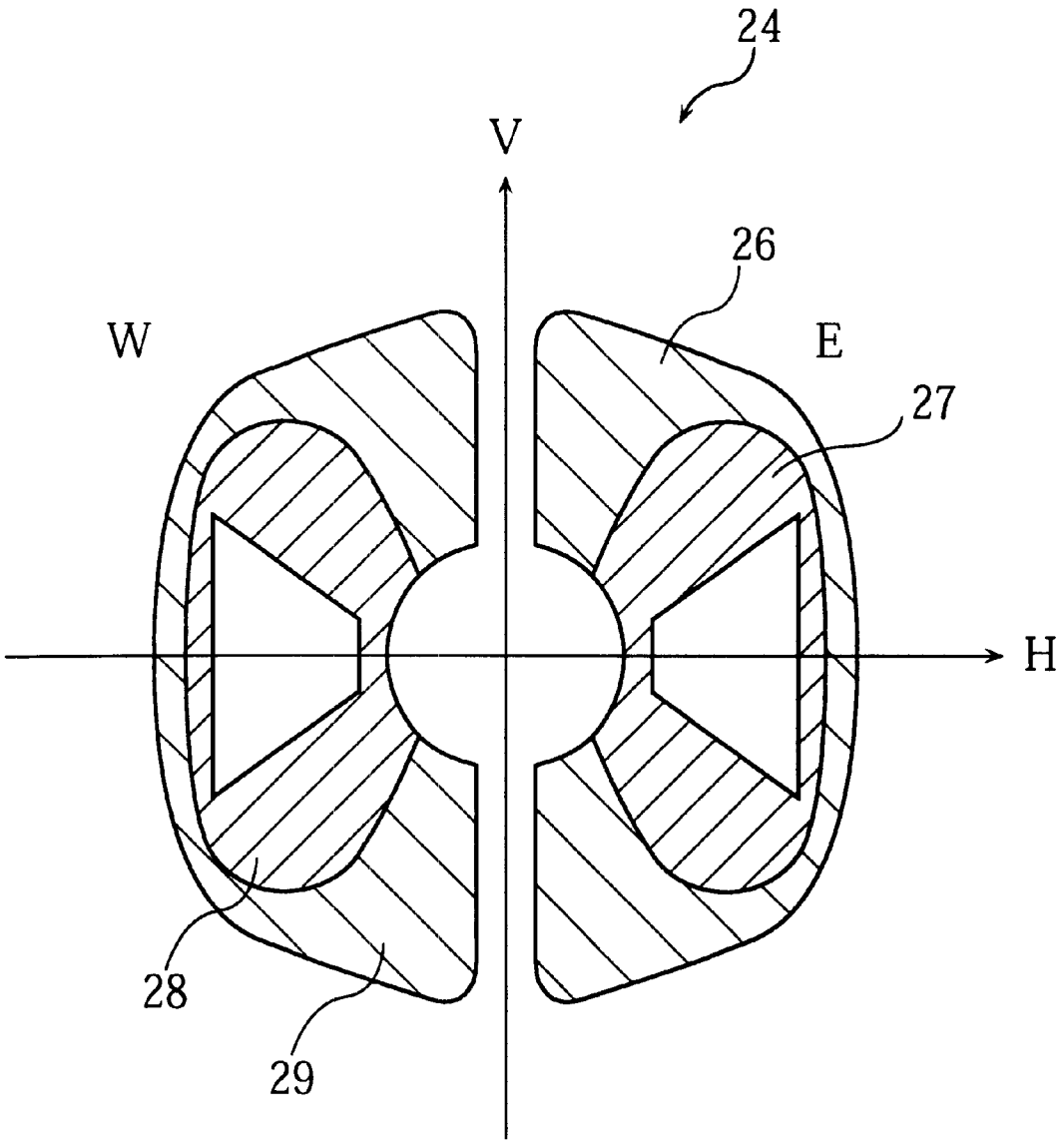
FIG. 13 is a view of a vertical deflection coil in the embodiments of the present invention, seen from the front of the display screen.
Figure 14:
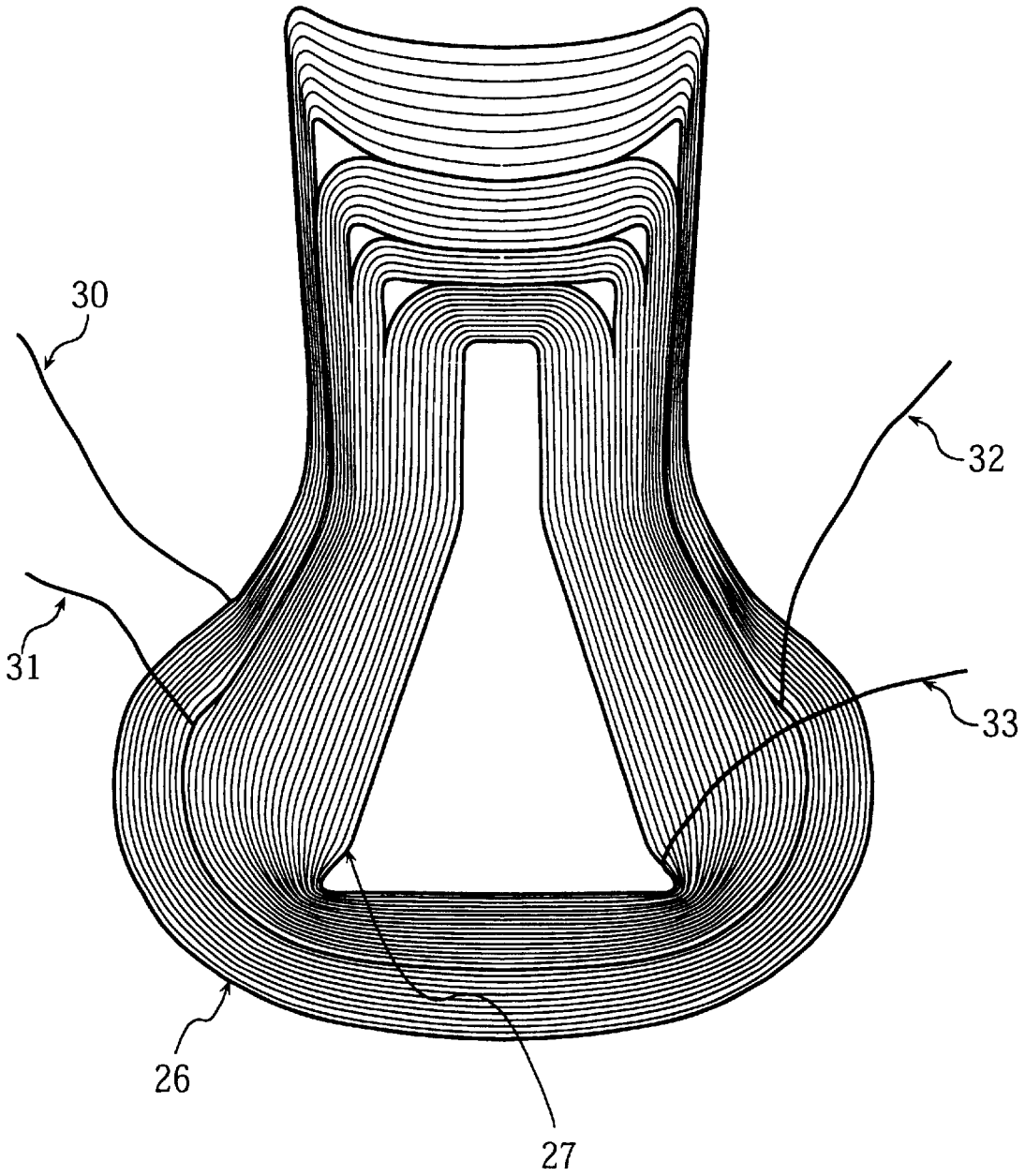
FIG. 14 is a perspective view of a vertical deflection yoke in the embodiments of the present invention.
Figure 15:
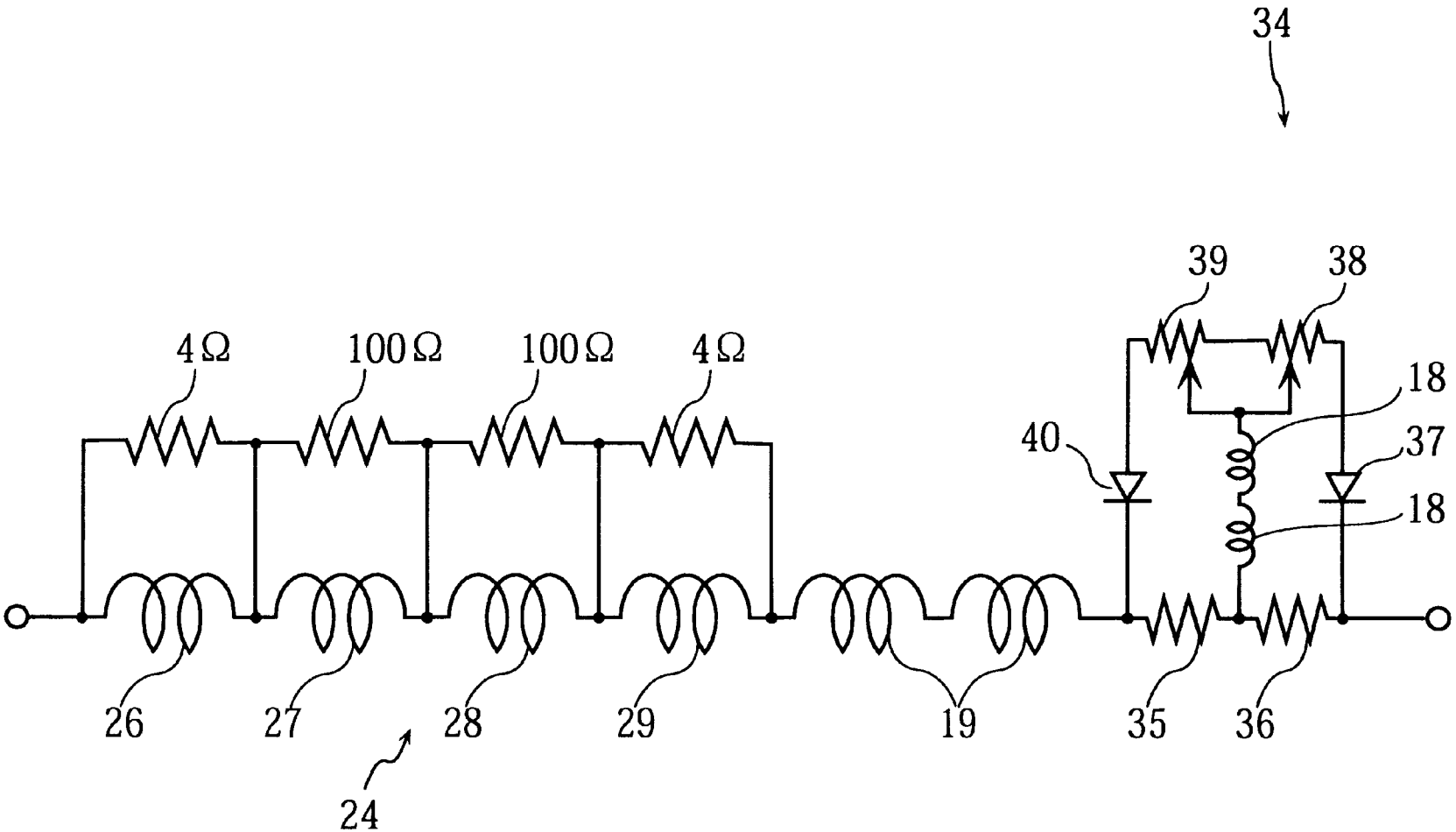
FIG. 15 is a circuit diagram showing a vertical deflection coil 24, a coma correction coil 19 and a four-pole coil 18.

FIG. 13 is a view of the vertical deflection coil 24 as seen from in front of the display screen. The vertical deflection coil 24 is divided into east and west coils E and W, arranged on either side of the vertical axis V, and these E and W coils are each further formed from inner and outer coils. In other words, the E coil is formed from an outer E coil 26 and an inner E coil 27, while the W coil is formed from an outer W coil 29 and an inner W coil 28. FIG. 14 is a perspective view of the E coil. As shown in the drawing, the inner and outer E coils 26 and 27 have leads 30 and 31, and 32 and 33, at their respective ends. An electric current is supplied via these leads 30 to 33. FIG. 15 is a circuit diagram of the vertical deflection coil 24, the coma correction coil 19, and the four-pole coil 18. The total number of turns for each of the E and W coils of the vertical deflection coil 24 is 98, and the inner and outer coils 26 to 29 forming these coils each have 49 turns. A damping resistor is connected in parallel to each of these inner and outer coils 26 to 29. The damping resistors connected in parallel to the inner coils 27 and 28 each have a resistance of 100 Ω, and the damping resistors connected in parallel to the outer coils 26 and 29 each have a resistance of 4 Ω. Here, the vertical deflection coil 24 is connected in series to the coma correction coil 19, and is also connected in series to the four-pole coil 18 via a peripheral circuit 34.

Coma Correction Coil 19

Figure 16:
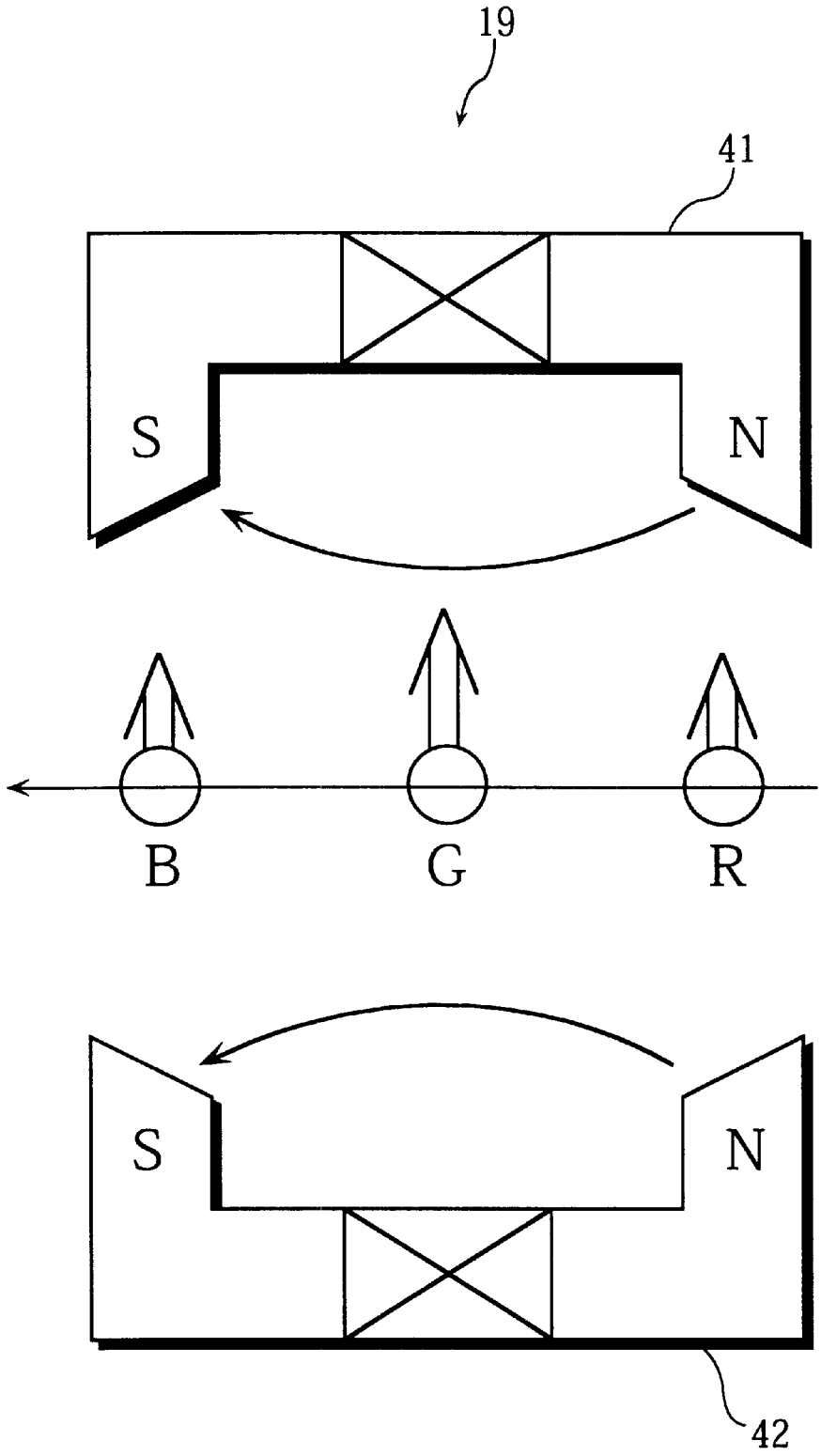
FIG. 16 is a view of the coma correction coil 19 seen from in front of the display screen.

FIG. 16 is a view of a coma correction coil 19 as seen from in front of the display screen. The coma correction coil 19 is wound around a pair of U-shaped cores 41 and 42, the U-shaped cores 41 and 42 being arranged in opposition at the top and bottom of the deflection yoke 17 on the side nearer to the electron gun 20. The coma correction coil 19 is wound around each of the U-shaped cores 41 and 42 for 93 turns. Furthermore, the coma correction coil 19 is connected so that the corresponding ends of each of the U-shaped cores 41 and 42 usually have the same polarity.

Four-Pole Coil 18

As shown in FIG. 15, the four-pole coil 18 is connected to the vertical deflection coil 24 via the peripheral circuit 34. The peripheral circuit 34 includes a series circuit having two resistors 35 and 36, and the cathodes of Schottky diodes 37 and 40 are connected respectively to either end of the series circuit. One end of each of variable resistors 38 and 39 is connected respectively to the anodes of the diodes 37 and 40, while the other end is connected to an intermediate connection point for resistors 35 and 36 via the four-pole coil 18. Here, the resistors 35 and 36 have the same resistance value.

Figure 17:
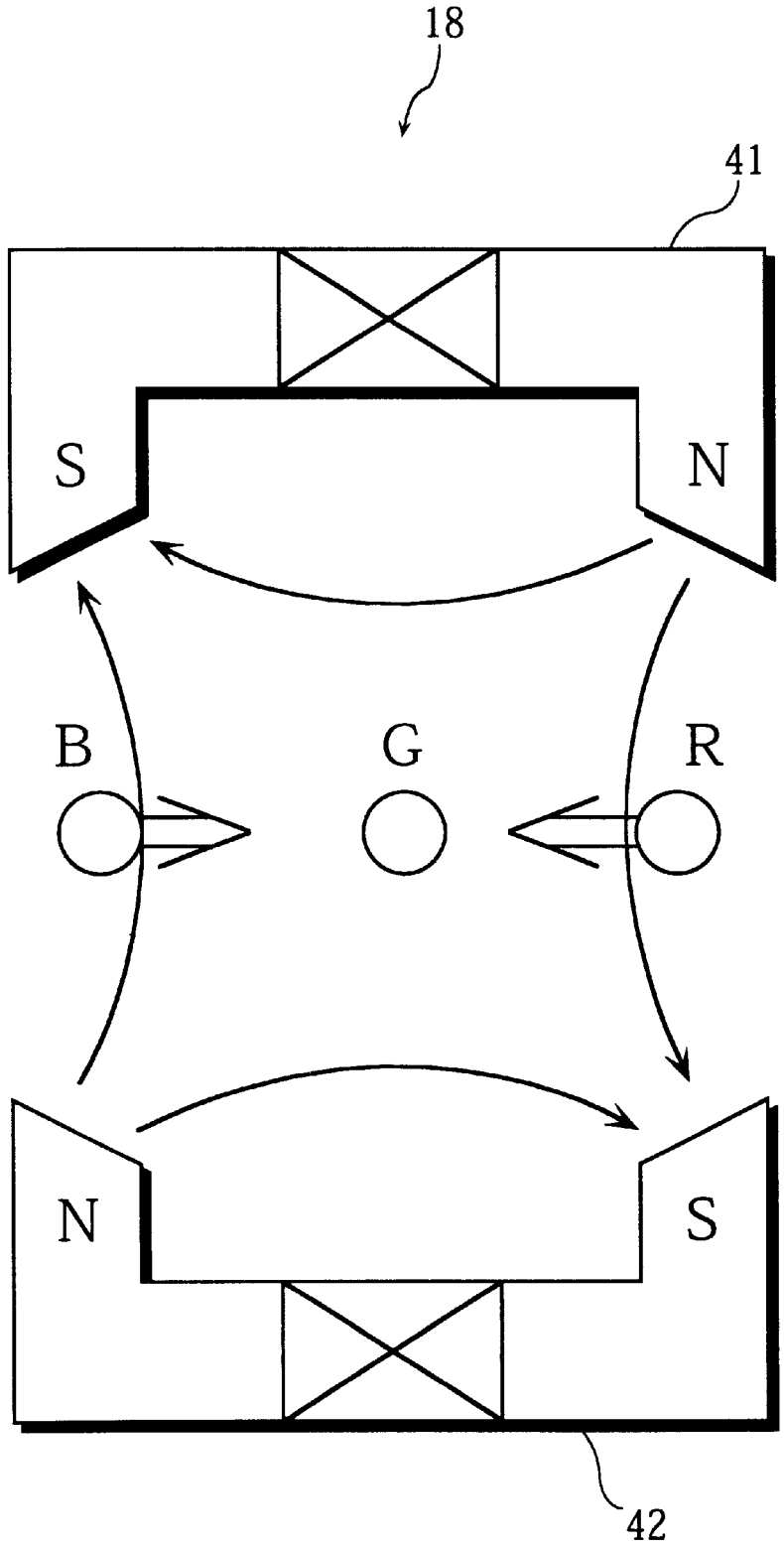
FIG. 17 is a view of the four-pole coil 18 seen from in front of the display screen.

FIG. 17 is a view of the four-pole coil 18 seen from in front of the display screen. The four-pole coil 18, like the coma correction coil 19, is wound about the U-shaped cores 41 and 42, the number of turns being 70 in each case. Electric current usually flows through the four-pole coil 19 in the same direction, as a result of rectifying performed by the diodes 37 and 40. This normally causes the four-pole coil 18 to generate a magnetic field like the one shown in FIG. 17, thereby applying a horizontal force to each of the electron beams B and R in the opposite direction to the four-pole coil 4 described in the related art (that is an inward rather than an outward force).

Winding Angle

Figure 18:
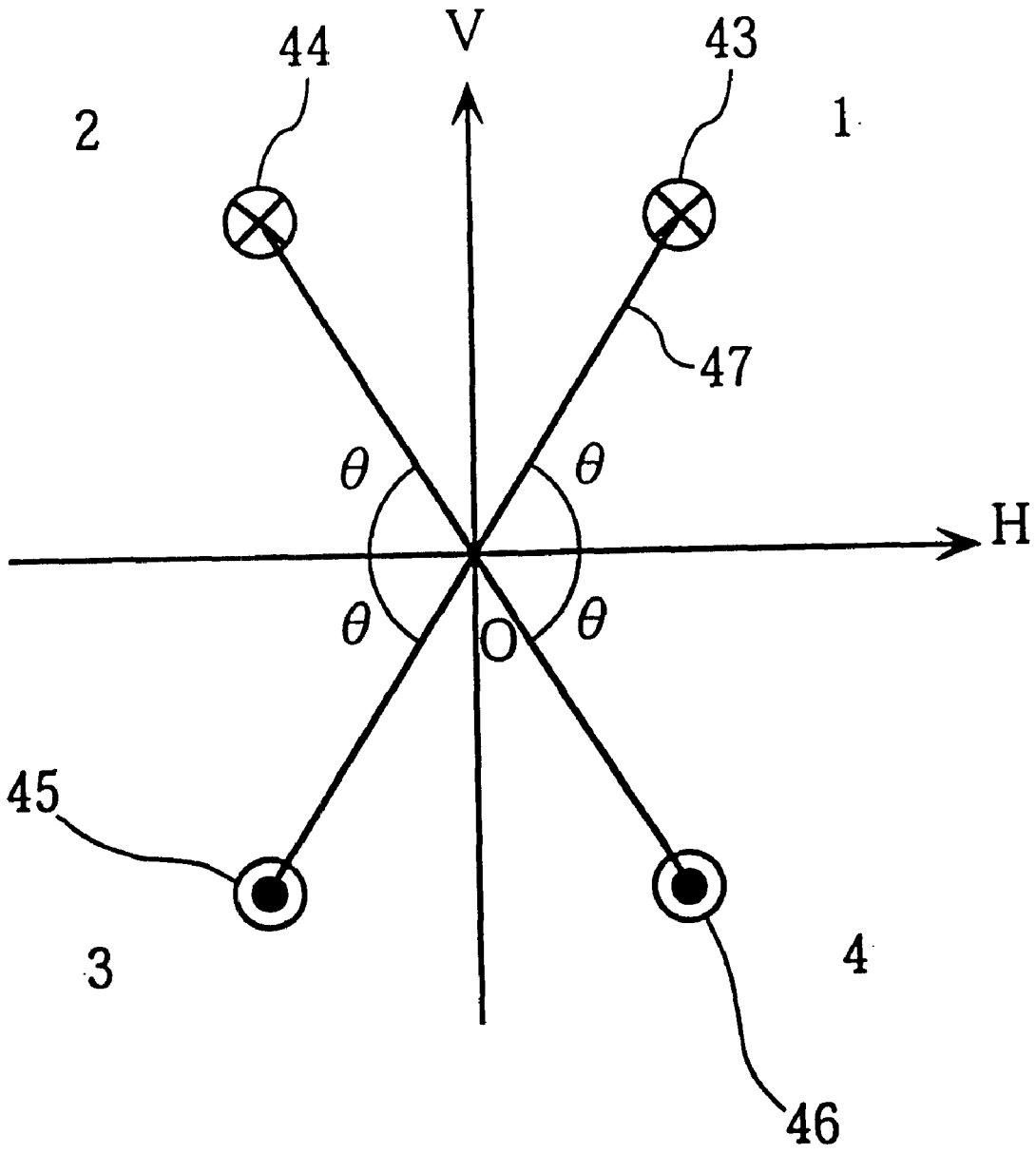
FIG. 18 shows a plane spanned by the horizontal axis H and the vertical axis V.

A given plane spanned by the horizontal axis H and the vertical axis V is divided into four quadrants. Angles formed between the horizontal axis and lines joining the origin O to points on the winding (coil) in the first quadrant of the plane are referred to as winding angles of the vertical deflection coil 24. An area corresponding to a given winding angle is a coil section determined by the winding angle in the first quadrant, and coil sections in each of the second to fourth quadrants that are symmetrical to the coil section in the first quadrant. FIG. 18 shows a plane spanned by the horizontal axis H and the vertical axis V. In FIG. 18 the winding angle of coil sections 43 to 46 is given as an angle θ, formed between (1) a straight line 47 joining the coil section 43 in the first quadrant to the origin O, and (2) the horizontal axis H. In the drawing, the symbol '⊗' has been given to the coil sections 43 and 44, indicating that current flows through these sections from the screen in the direction of the electron gun 20, while a symbol '⊙' has been given to coil sections 45 and 46, indicating that current flows through these sections in the reverse direction, that is from the electron gun 20 to the screen. Conventionally, current flows in one direction through the coils positioned in the first and second quadrants of a vertical deflection coil, and in the opposite direction through the coils positioned in the third and fourth quadrants.

Figure 19:
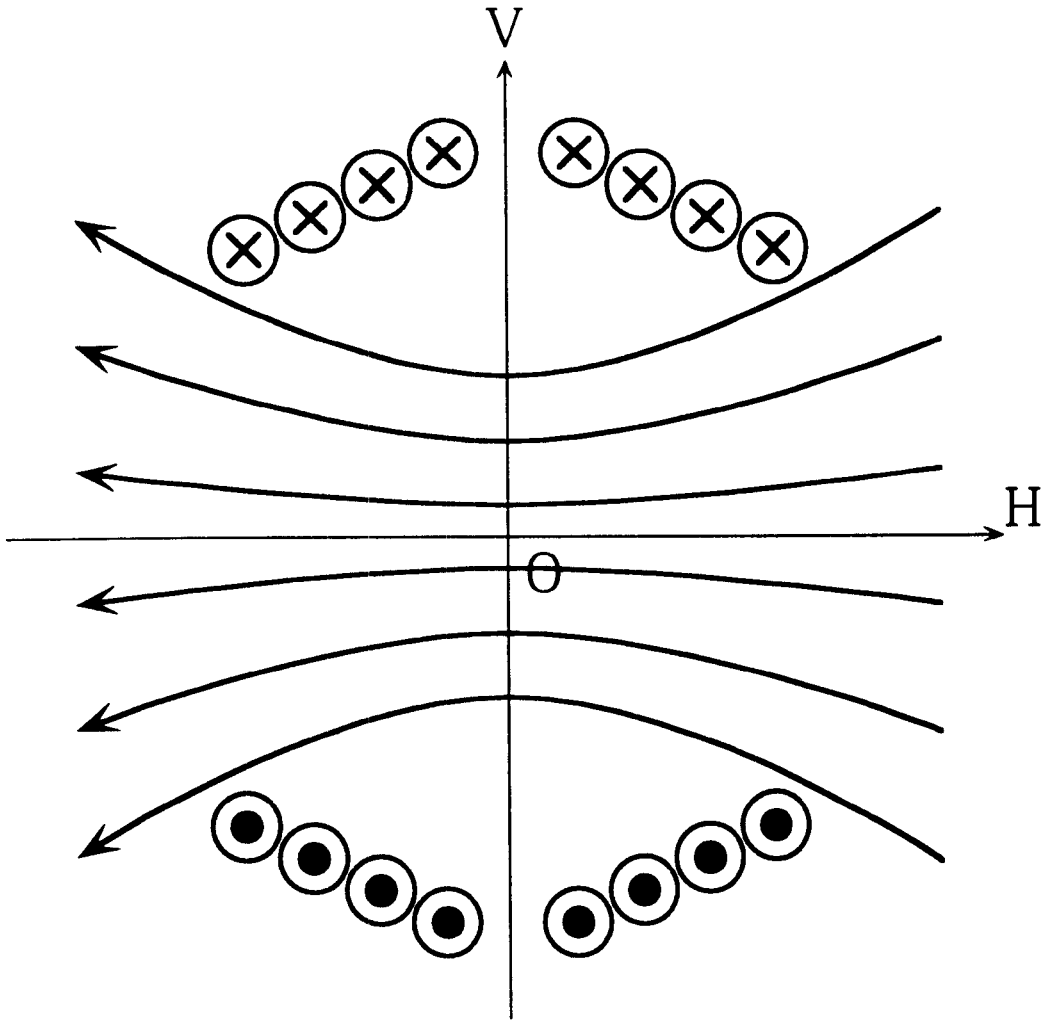
FIG. 19 shows magnetic flux for a magnetic field generated by coil sections with a large winding angle.
Figure 20:
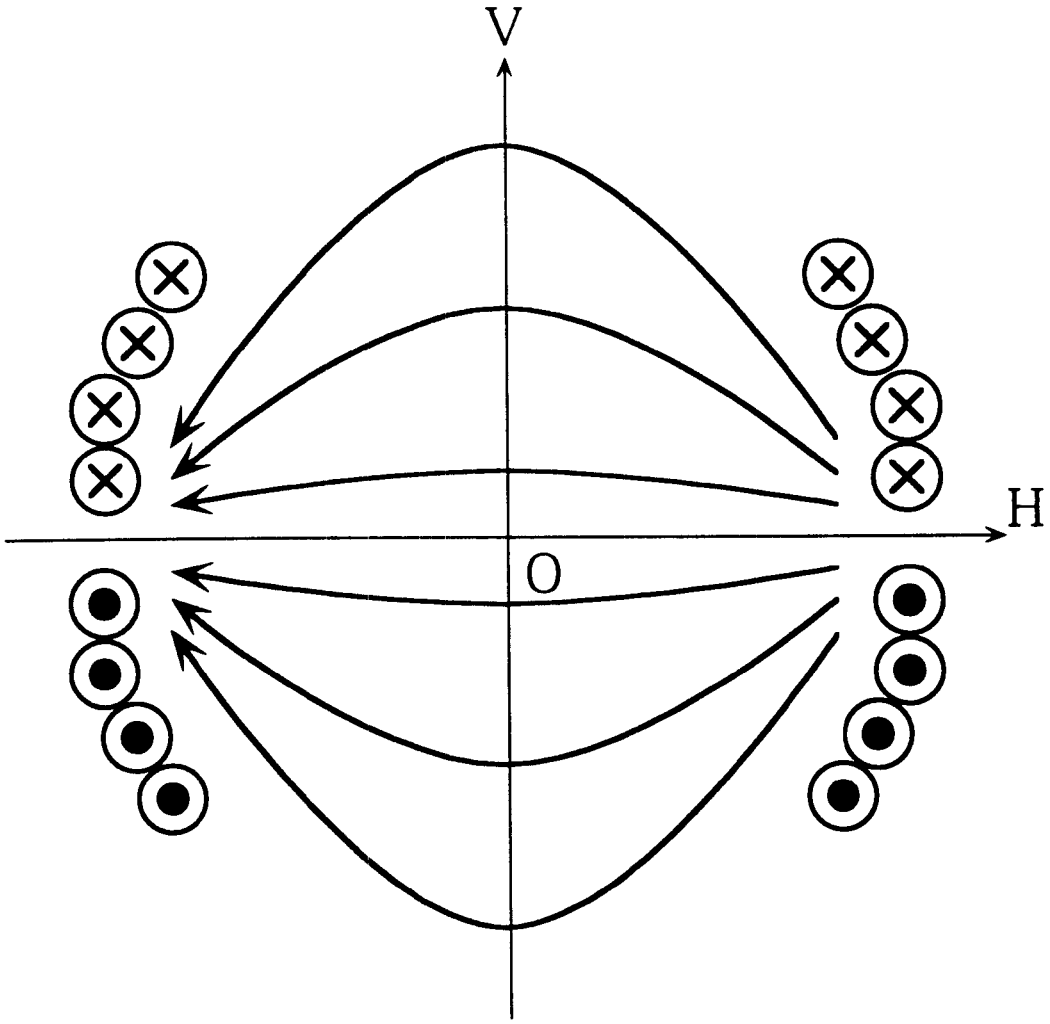
FIG. 20 shows magnetic flux for a magnetic field generated by coil sections with a small winding angle.

FIG. 19 shows magnetic flux for a magnetic field generated by coil sections with a large winding angle (in other words coil sections in outer coils 26 and 29). As shown in the drawing, a magnetic field generated by coil sections with a large winding angle is distorted in a pincushion shape. Meanwhile, FIG. 20 shows magnetic flux for a magnetic field generated by coil sections with a small winding angle (in other words coil sections in inner coils 27 and 28). As shown in the drawing, a magnetic field generated by the coil sections with a small winding angle is distorted in a barrel shape. To be precise, coil sections with a winding angle of 60° or more will generate a magnetic field distorted in a pincushion shape, and coil sections with a winding angle smaller than this will generate a magnetic field distorted in a barrel shape.

Correction of PQV Barrel Pattern Misconvergence

Figure 1:
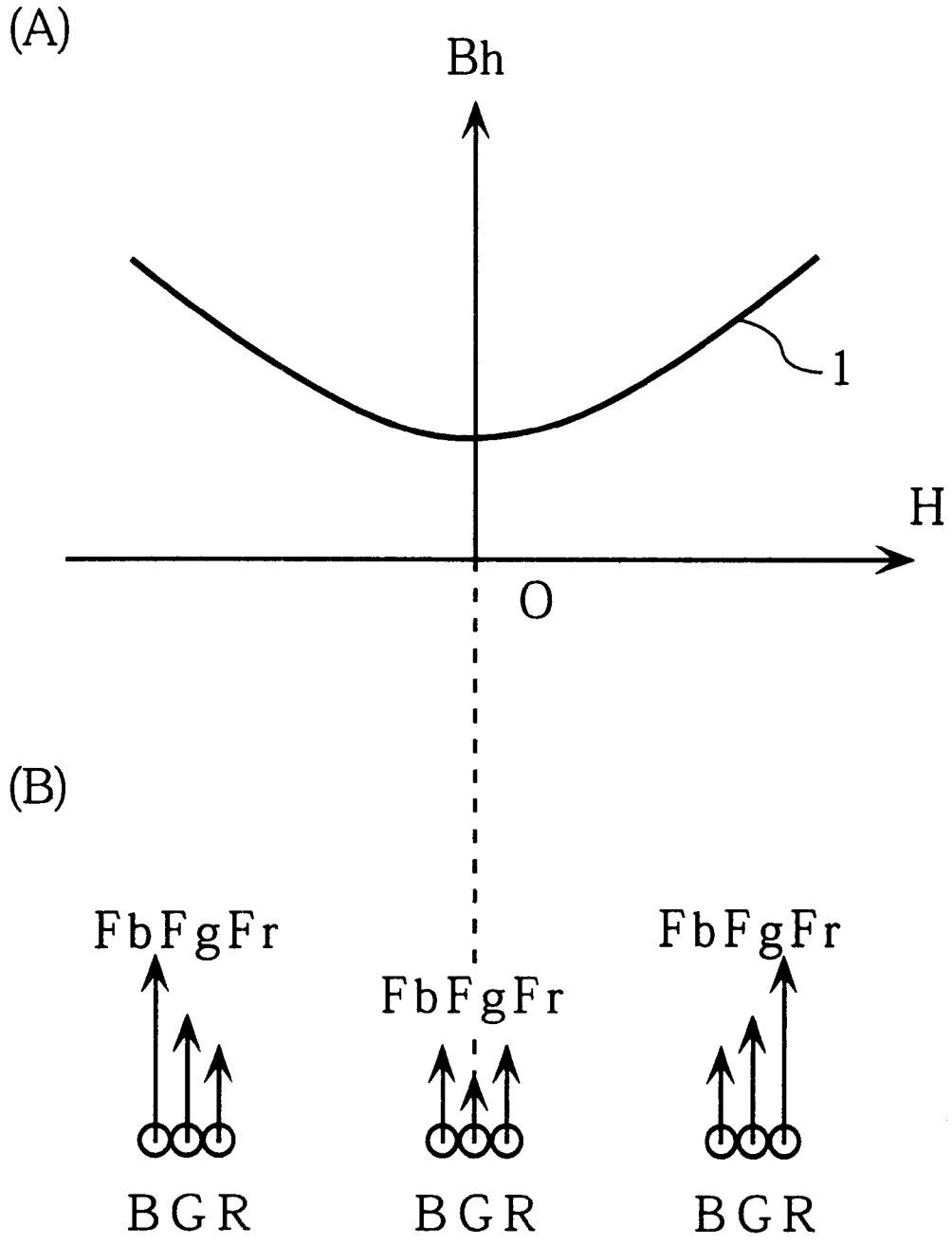
FIG. 1 is a graph showing variations in the strength of horizontal component of a vertical deflection field along a horizontal axis H, and forces exerted on electron beams by the horizontal component.
Figure 2:
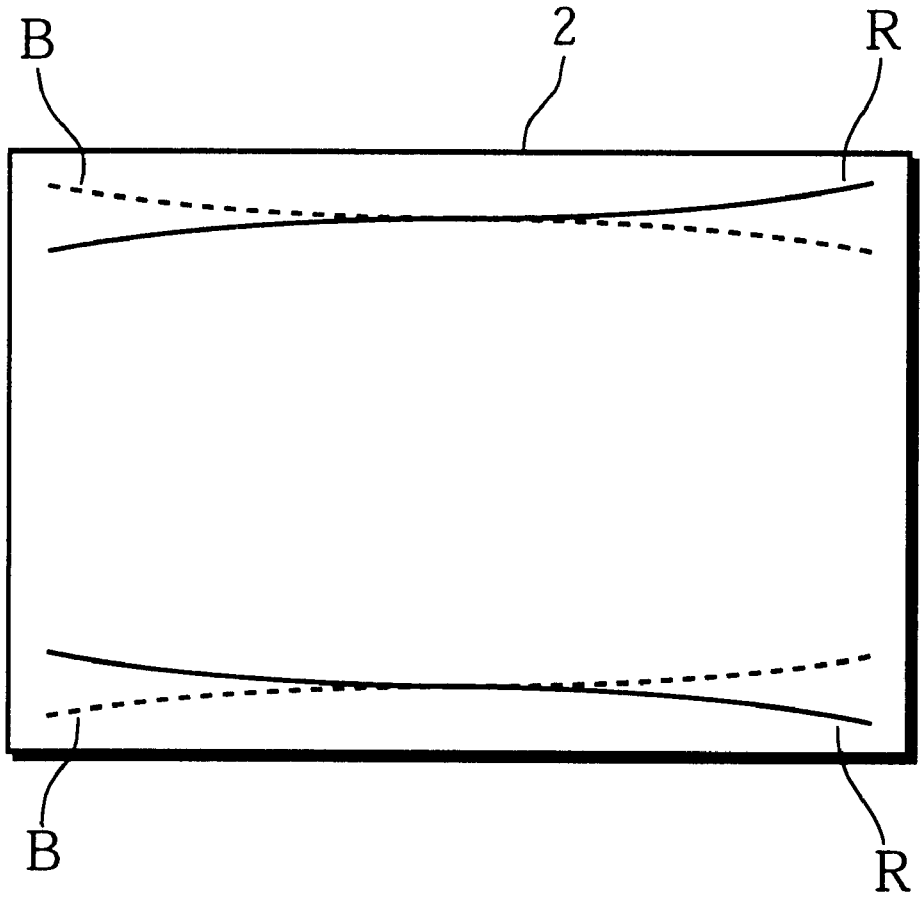
FIG. 2 shows PQV pincushion pattern misconvergence.
Figure 3:
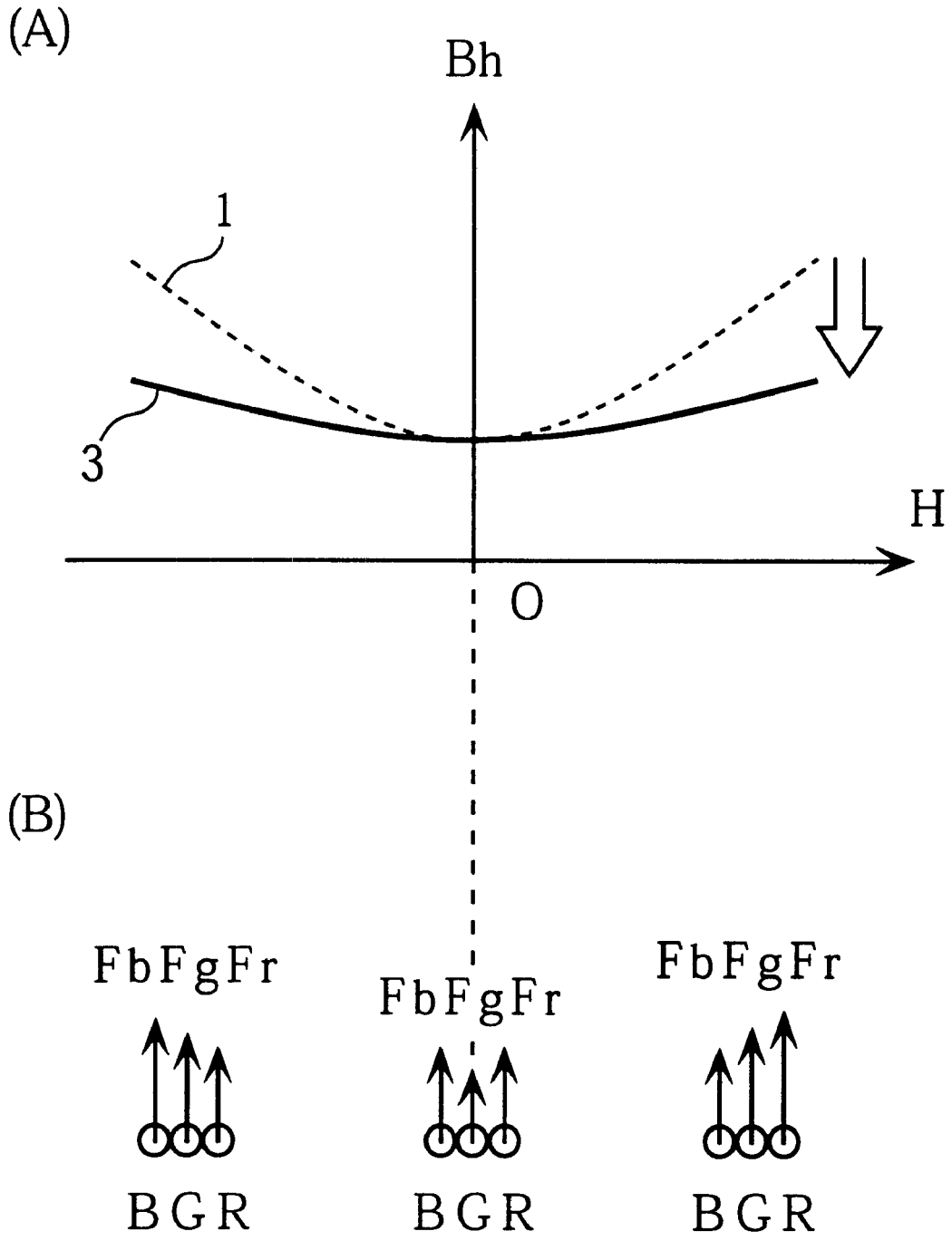
FIG. 3 is a graph showing variations in the horizontal component of the vertical deflection field before and after barrel distortion of the vertical deflection field has been relieved, and forces exerted on electron beams by the horizontal component once barrel distortion of the vertical deflection field has been relieved.
Figure 4:
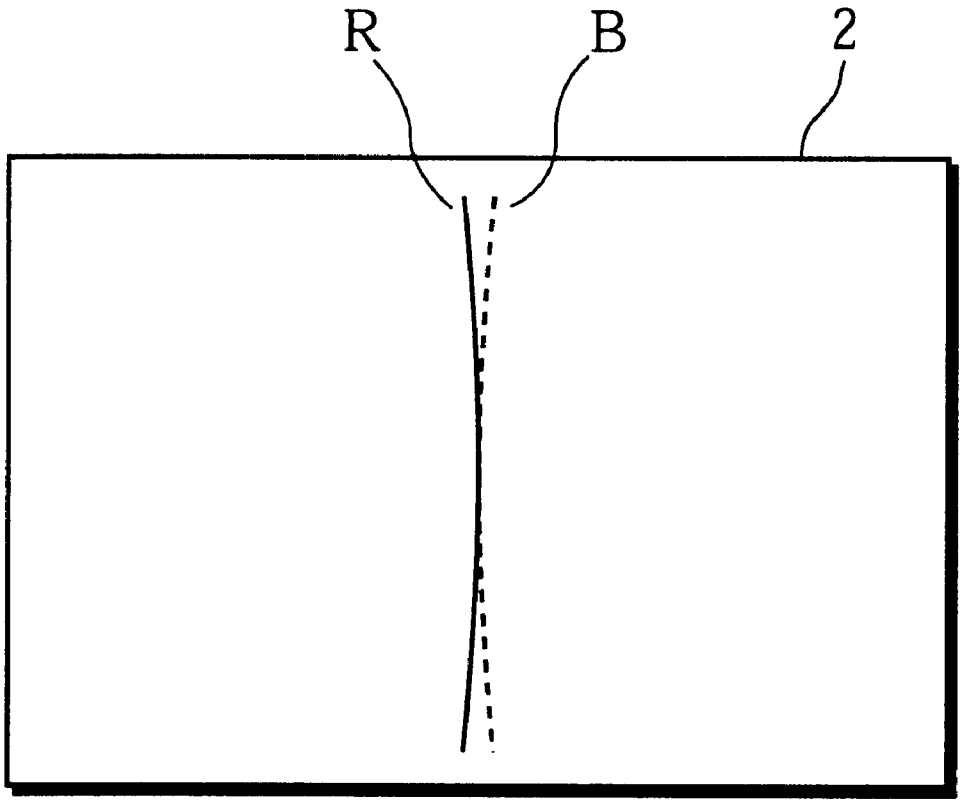
FIG. 4 illustrates YH pincushion pattern misconvergence.
Figure 5:
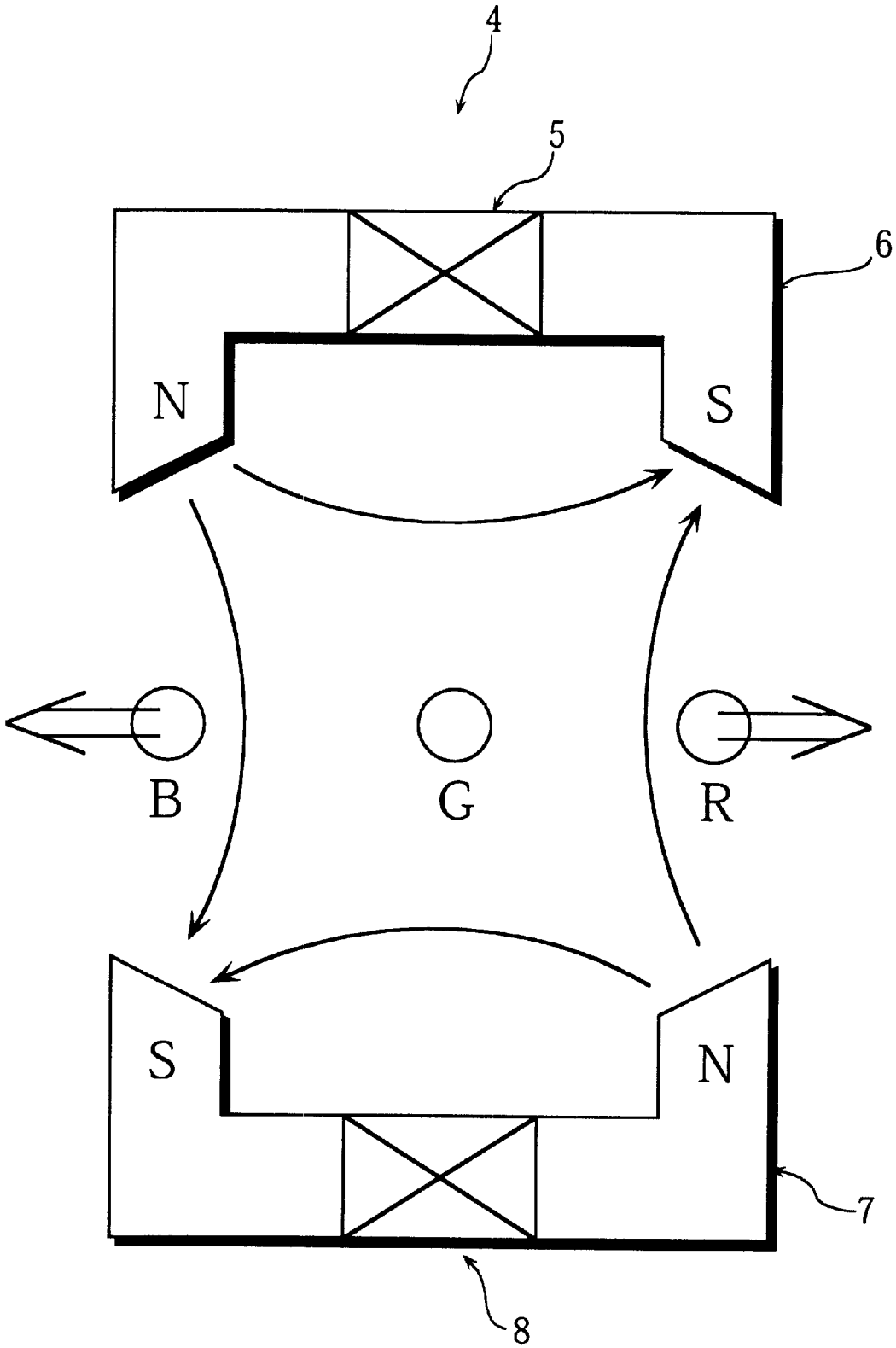
FIG. 5 is a view of a four-pole coil disclosed in Japanese Laid Open Patent 8-98193, seen from in front of a display screen.
Figure 6:
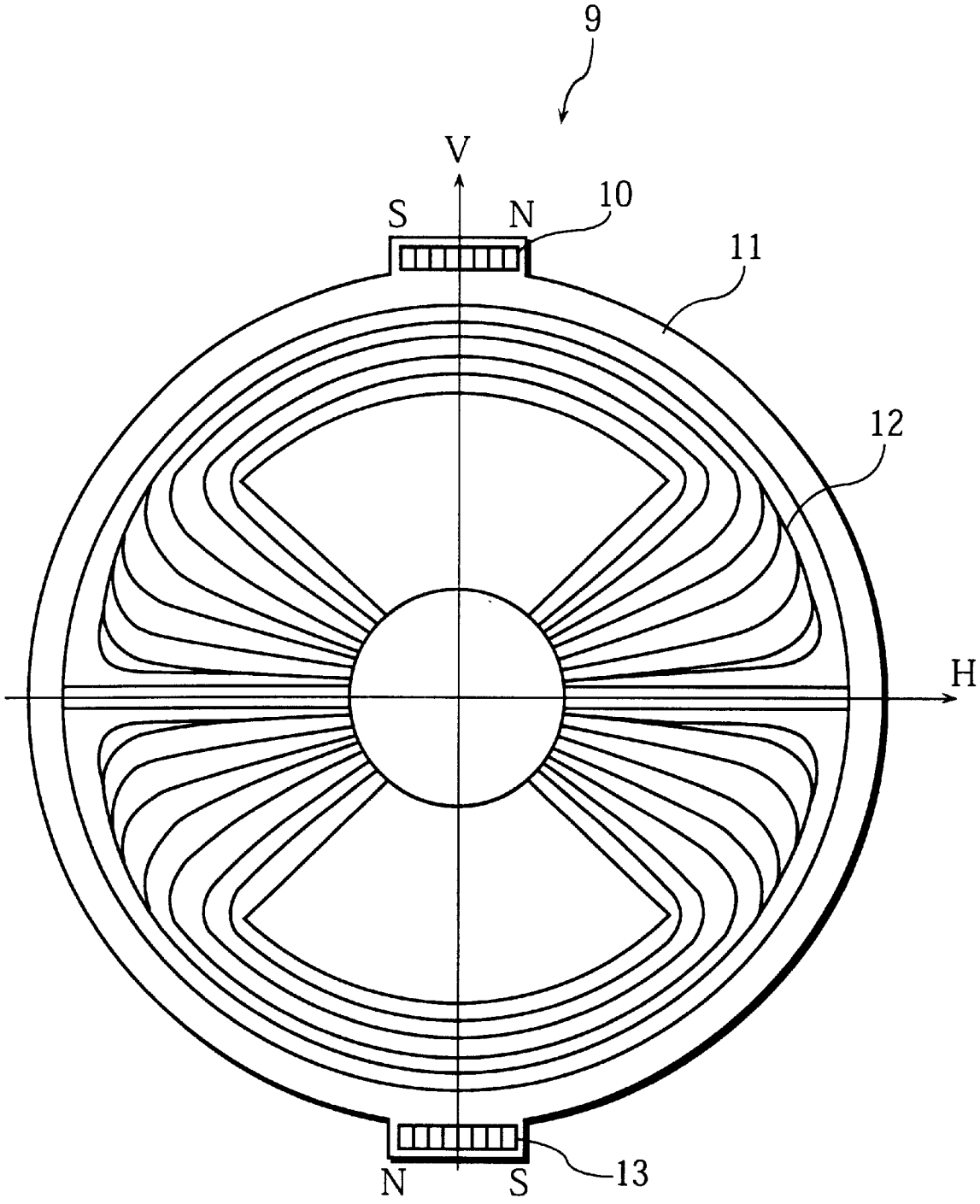
FIG. 6 is a view of a deflection yoke to which magnets have been attached, seen from in front of the display screen.
Figure 7:
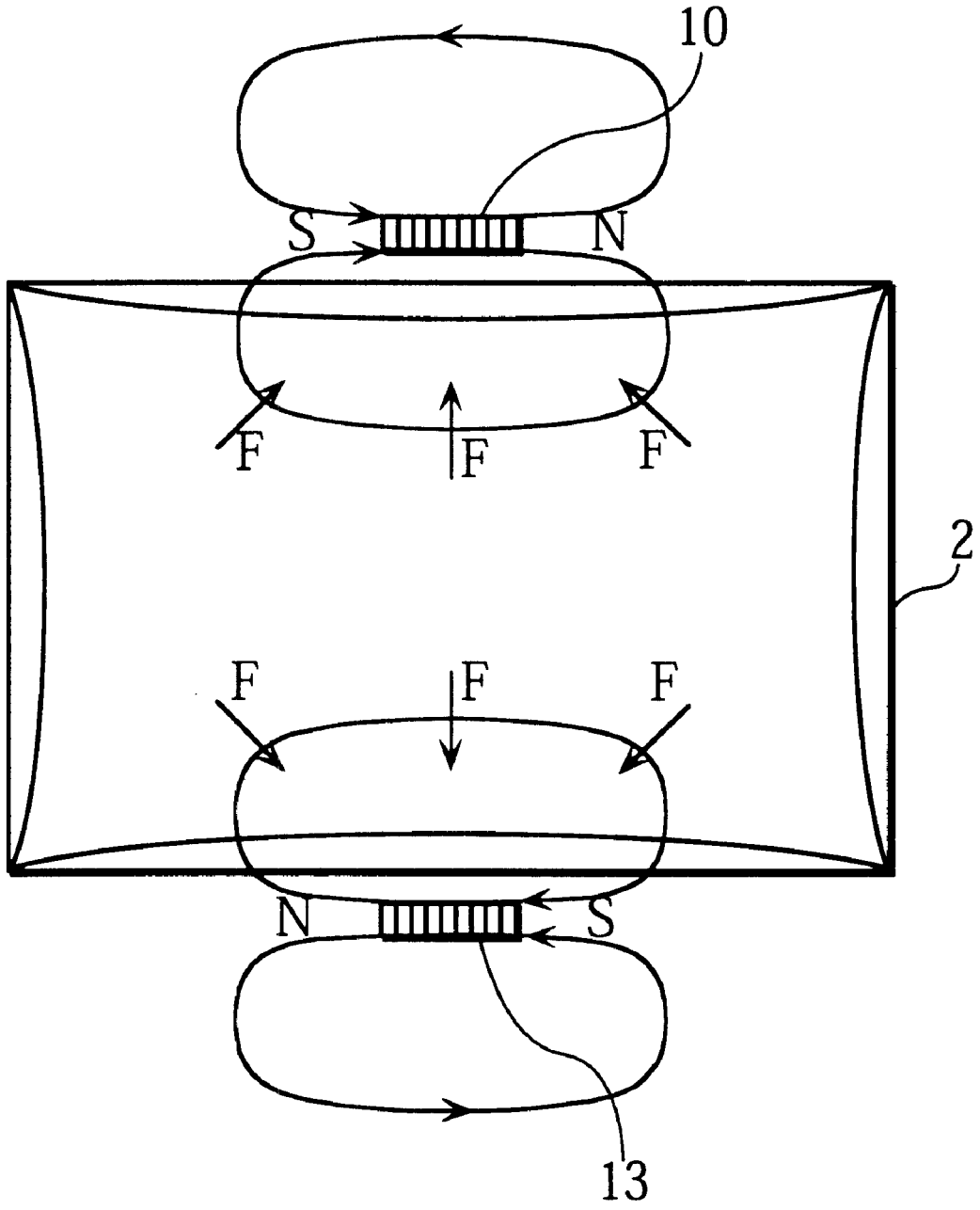
FIG. 7 shows magnetic lines of force generated by the magnets, and forces exerted on the electron beams by the magnetic lines of force.
Figure 8:
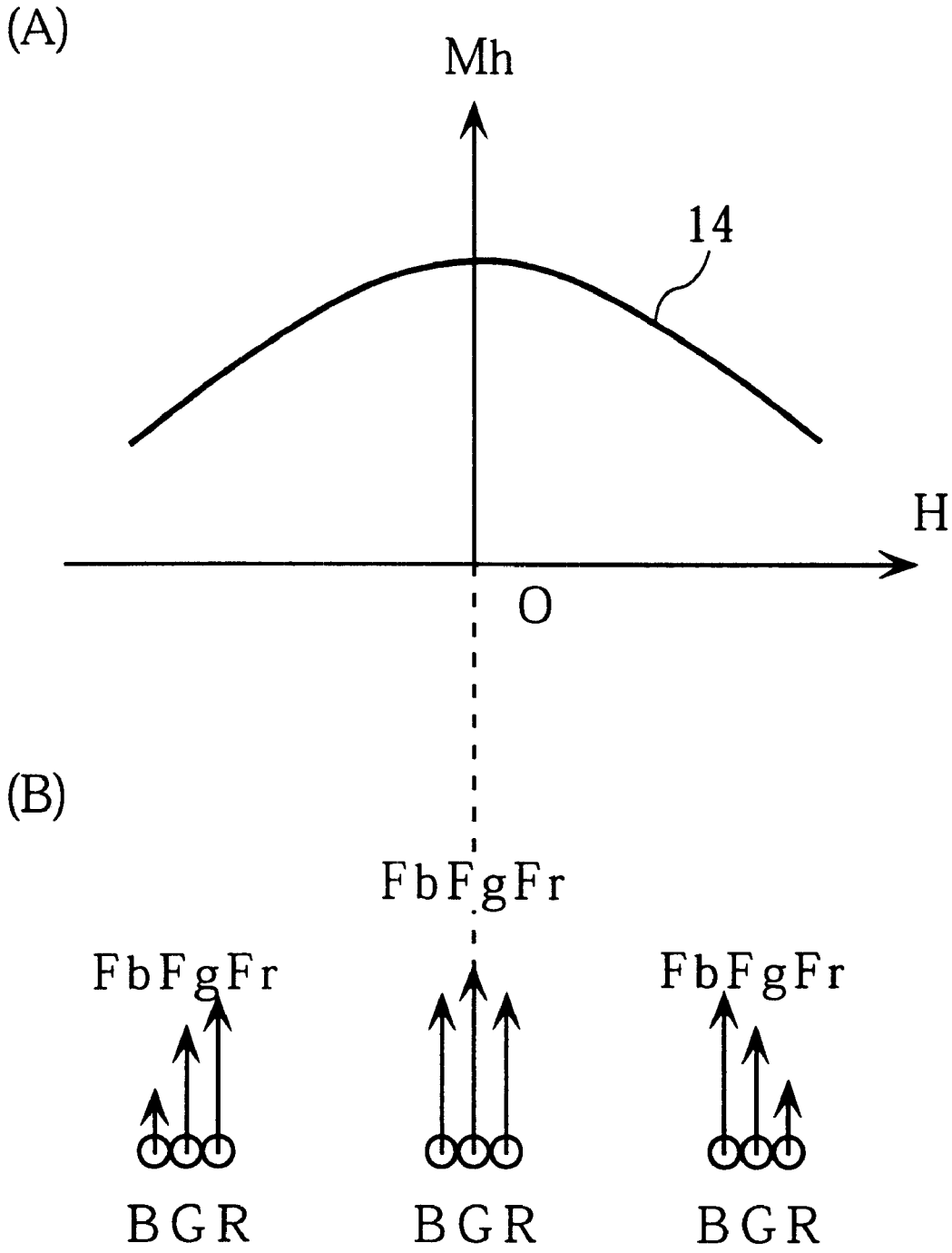
FIG. 8 is a graph showing variations in the strength of the horizontal component of the magnetic field generated by the magnets, along the horizontal axis H, and the force exerted on the electron beams by the horizontal component.
Figure 9:
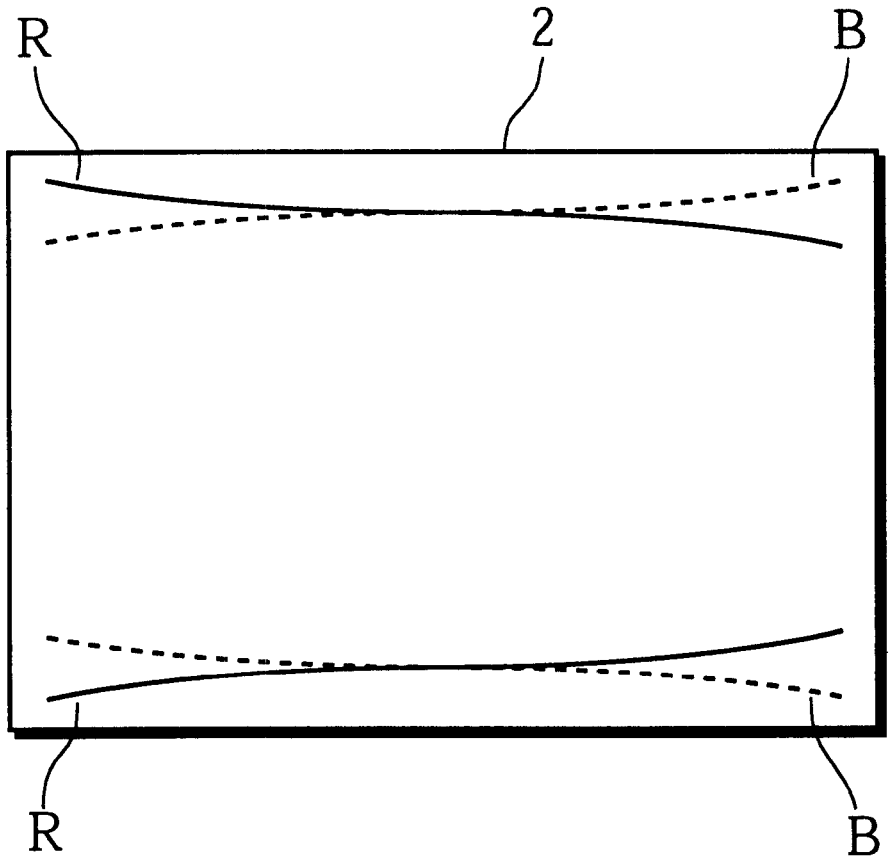
FIG. 9 shows PQV barrel pattern misconvergence.

In the display monitor 15 of the present embodiment, the damping resistors connected in parallel to the inner coils 27 and 28 each have a resistance of 100 Ω, and the damping resistors connected in parallel to the outer coils 26 and 29 each have a resistance of 4 Ω. As a result, the magnetic field generated by the inner coils 27 and 28 is stronger than that generated by the outer coils 26 and 29. In other words, a magnetic field generated by coil sections with a small winding angle is stronger than the magnetic field generated by coil sections with a large winding angle. Since a magnetic field generated by coil sections with a small winding angle is distorted in a barrel shape, this ultimately means that the barrel distortion of the vertical deflection field generated by the vertical deflection coil 24 is stronger. As a result, the differences in the forces Fb, Fg, and Fr, shown in FIG. 1, that are applied to the electron beams are increased, thereby correcting PQV barrel pattern misconvergence.

However, if the barrel distortion of the vertical deflection field is strengthened in this way, YH pincushion pattern misconvergence will be overcorrected, and YH barrel pattern misconvergence, PQH red right pattern misconvergence, and VCR misconvergence will be generated. YH barrel pattern misconvergence and PQH red right pattern misconvergence are corrected by the four-pole coil 18, and the VCR misconvergence by the coma correction coil 19. This process is described below.

Correction of YH Barrel Pattern Misconvergence

Figure 21:
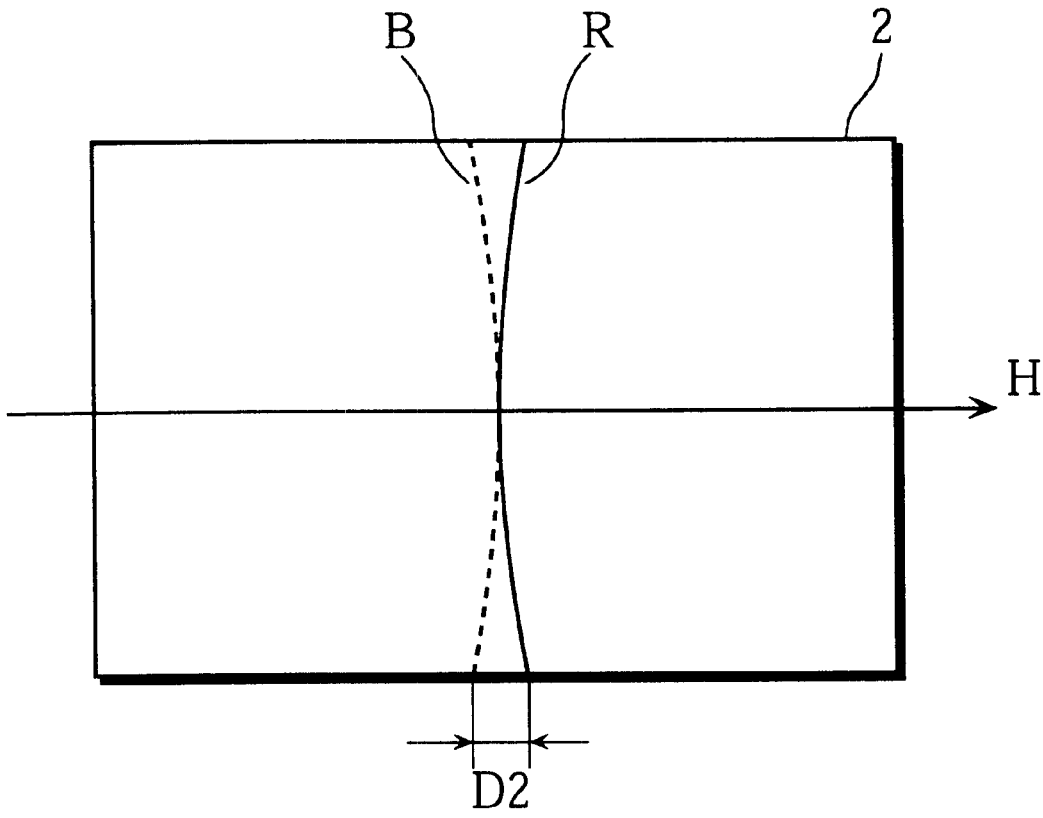
FIG. 21 shows YH barrel pattern misconvergence.

If the barrel distortion of the vertical deflection field is strengthened as described above, YH barrel pattern misconvergence is generated. FIG. 21 shows YH barrel pattern misconvergence. When a magenta line is displayed vertically at the center of the horizontal axis, the influence of barrel distortion of the vertical deflection field causes a red component R and a blue component B of the magenta line to diverge to the left and right as they move further from the horizontal axis H and nearer to the top and bottom of the screen. At the extreme top and bottom of the screen, the components R and B are separated by a distance D2, equal to about 0.6 mm. This level of misconvergence can be corrected by the four-pole coil 18. As shown in FIG. 17, the magnetic field generated by the four-pole coil 18 applies an inward horizontal force to each of the electron beams R and B, this force being synchronized with vertical deflection. However, this has no effect whatsoever on the electron beam G. As a result, electron beams R and B receive a stronger inward force when the vertical deflection angle is larger. This means that the red component R and the blue component B will be brought together, thereby eliminating YH barrel pattern misconvergence.

Correction of PQH Red Right Pattern Misconvergence

Figure 10:
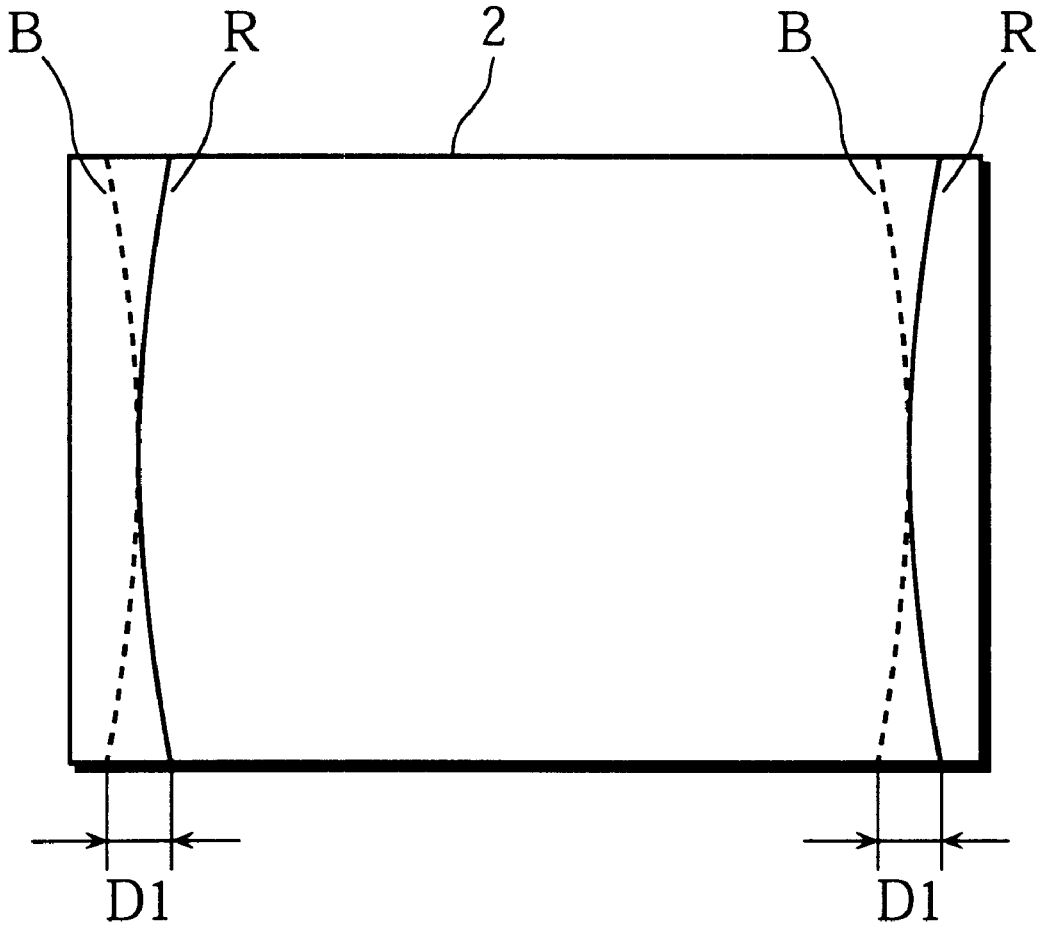
FIG. 10 shows PQH red right pattern misconvergence.

PQH red right pattern misconvergence generated due to a strong barrel distortion of the vertical deflection field is also corrected using the four-pole coil 18. In the present embodiment, the size of the PQH red right pattern misconvergence prior to correction by the four-pole coil 18 is the distance D1 shown in FIG. 10, here approximately 1.1 mm. The four-pole coil 18 in the color CRT of the present embodiment can correct approximately twice as much YH misconvergence (divergence of the red and blue components in relation to the horizontal) at the left and right sides of the display screen than at the center of the display screen. As a result, distance D1 is approximately twice the size of distance D2, thereby enabling YH barrel pattern misconvergence and PQH red right pattern misconvergence to be simultaneously corrected by the four-pole coil 18.

VCR Misconvergence

Figure 22:
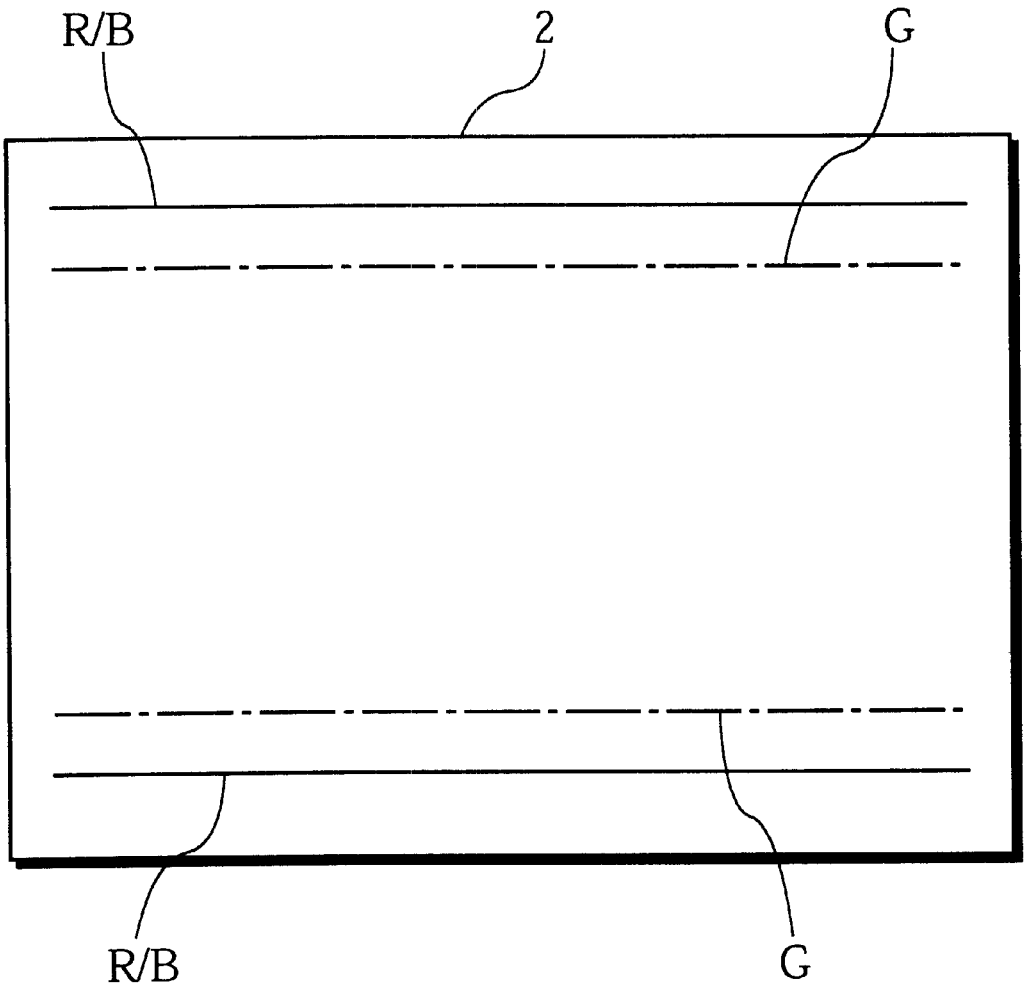
FIG. 22 shows VCR misconvergence.

VCR misconvergence is corrected using the coma correction coil 19. FIG. 22 shows VCR misconvergence. When white lines are displayed horizontally along the top and bottom of the display screen, the red and blue components R and B match, but a green component G diverges from the other two components. This misconvergence, in which the red and blue components R and B are displayed outside of the green component G, is known as VCR misconvergence. VCR misconvergence becomes more marked nearer to the top and bottom of the display screen, and is not visible in the central part of the screen. The coma correction coil 19 generates a pincushion distortion field, as shown in FIG. 18, thereby correcting VCR misconvergence. In other words, since the field generated by the coma correction coil 19 is distorted in a pincushion shape, the electron beam G, in accordance with Fleming's Law, receives a force that is largest in a direction parallel with a vertical deflection direction. The electron beams R and B also receive the same force parallel with the vertical deflection direction, but this force is smaller than that exerted on the electron beam G. Furthermore, since the coma correction coil 19 receives a vertical deflection current in order to generate a magnetic field, the difference between the force exerted on the electron beams R and B, and the force exerted on the electron beam G is greater when the vertical deflection angle is larger and, conversely, less when the vertical deflection angle is smaller. The coma correction coil 19 corrects VCR misconvergence in this way.

Strengthening barrel distortion of the vertical deflection field by adjusting the damping resistors for each of the inner and outer coils forming the vertical deflection coil, and further combining this with the effects produced by the four-pole coil 18 and the coma correction coil 19, enables misconvergence generated in a color CRT with a wide deflection angle and a virtually flat screen, and in particular misconvergence generated by magnets in such a color CRT, to be corrected.

As explained previously, the YH pincushion pattern misconvergence caused by a magnetic field generated by magnets is too severe to be corrected by the four-pole coil 18. However, if the barrel distortion of the vertical deflection field is increased, thereby changing the misconvergence to YH barrel pattern misconvergence, the misconvergence can be reduced to a level correctable by the four-pole coil 18. This means that, ultimately, any type of misconvergence can be corrected by the apparatus described in this specification.

Figure 23:
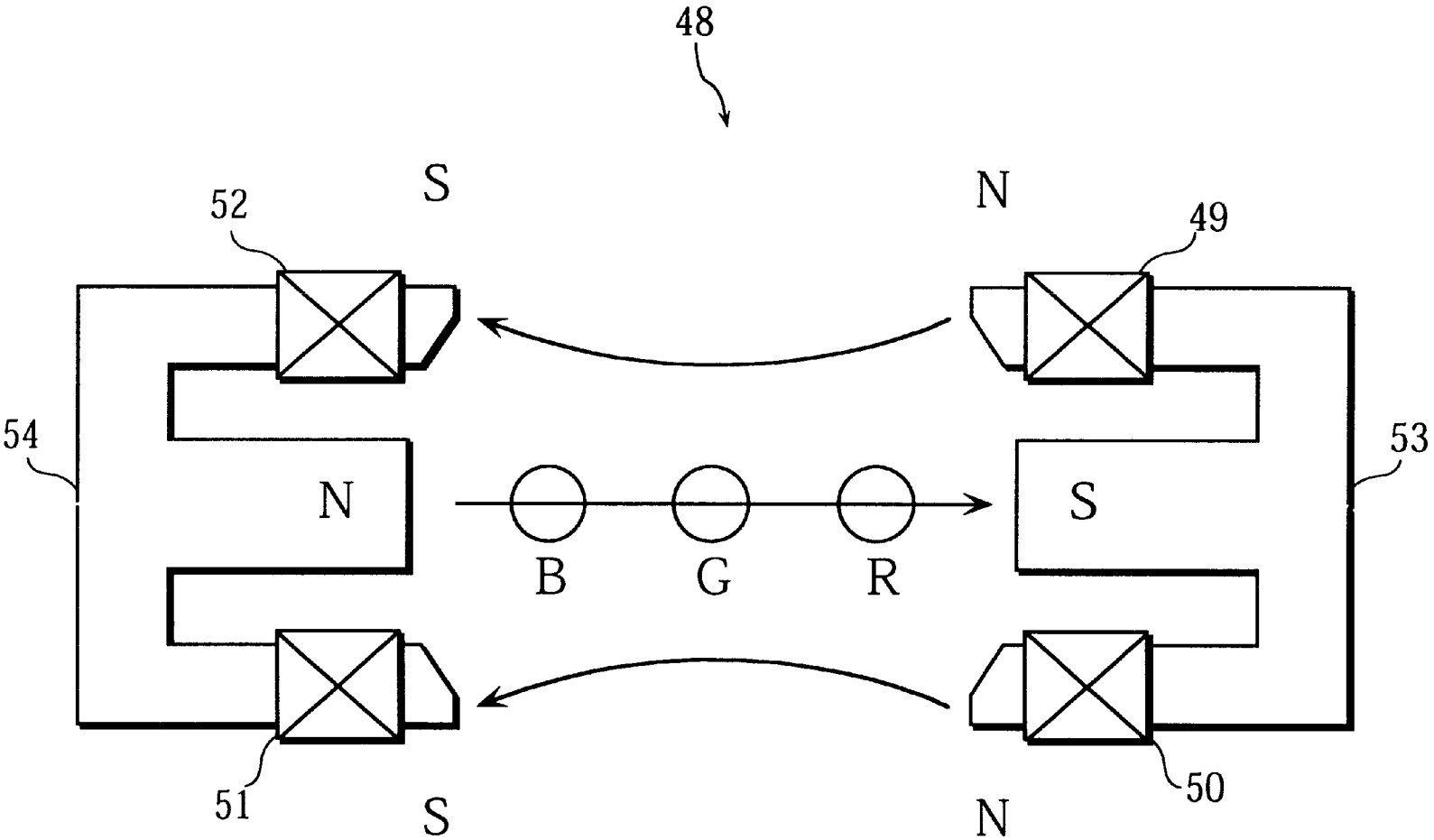
FIG. 23 is a view of a coma correction coil 48 using an E-shaped core, seen from the front of the display screen.

Similar effects to those described above can still be achieved if a coma correction coil with E-shaped cores rather than U-shaped cores is used. FIG. 23 is a view of a coma correction coil 48 that uses E-shaped cores, seen from in front of the display screen. In the drawing, the coma correction coil 48 includes a pair of E-shaped cores 53 and 54, and coils 49 to 52 that are wound around the E-shaped cores 53 and 54. The coma correction coil 48 is arranged on side of the deflection yoke 17 nearer to the electron gun 20. The coma correction coil 48 generates a pincushion-shaped magnetic field similar to that generated by the coma correction coil 19, thereby correcting VCR misconvergence.

A four-pole coil using E-shaped cores can achieve similar effects to those described above. Furthermore, the four-pole coil and the coma correction coil may also share the same E-shaped cores.

Second Embodiment

In the first embodiment, adjustment of the damping resistors for each inner and outer coil of the vertical deflection coil strengthened the barrel distortion of the vertical deflection field. In the second embodiment, however, barrel distortion of the vertical deflection field is strengthened by attaching a permalloy to the deflection yoke.

Figure 24:
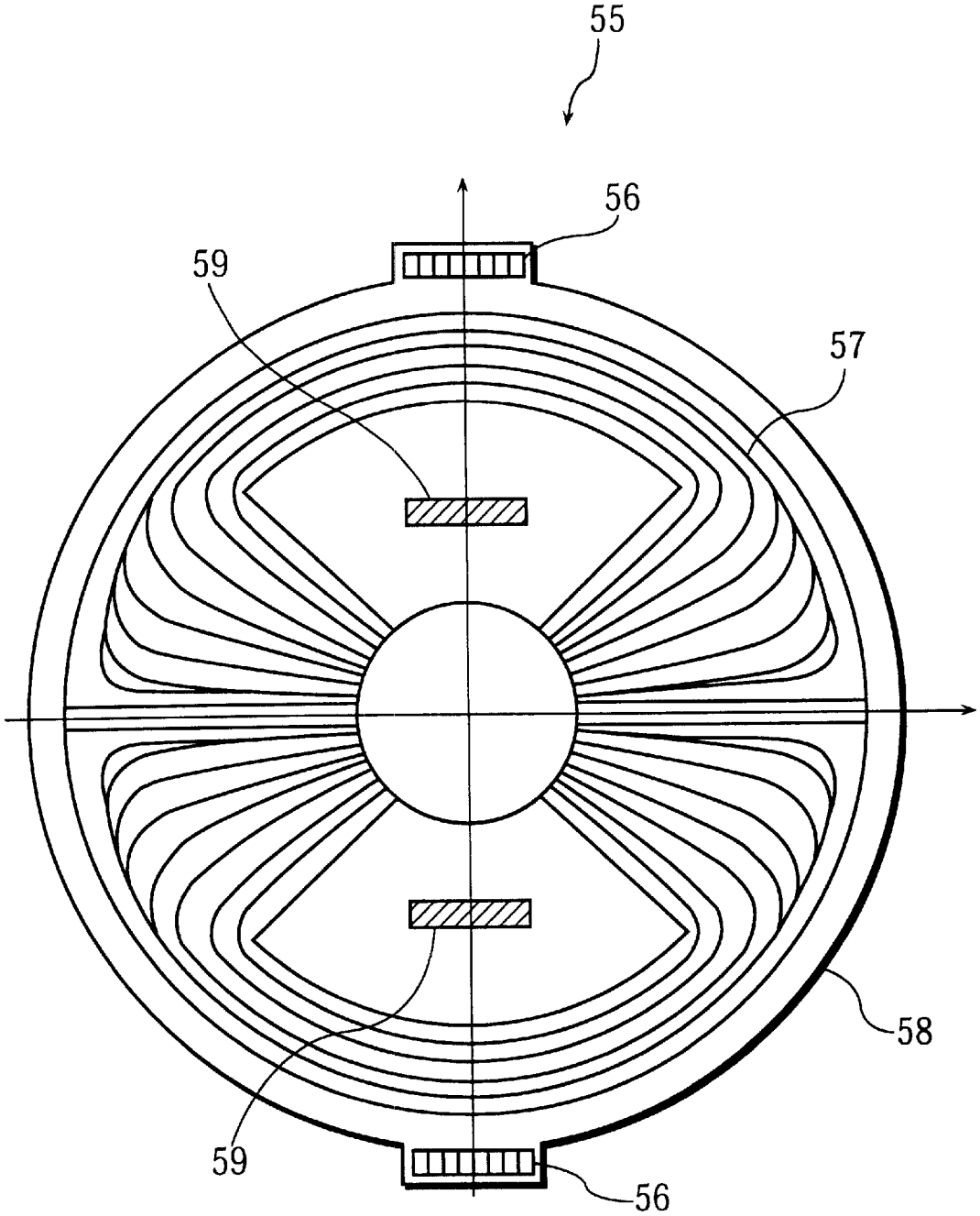
FIG. 24 is a view of a deflection yoke in a display monitor in the embodiments of the present invention, seen from the front of the display screen.
Figure 25:
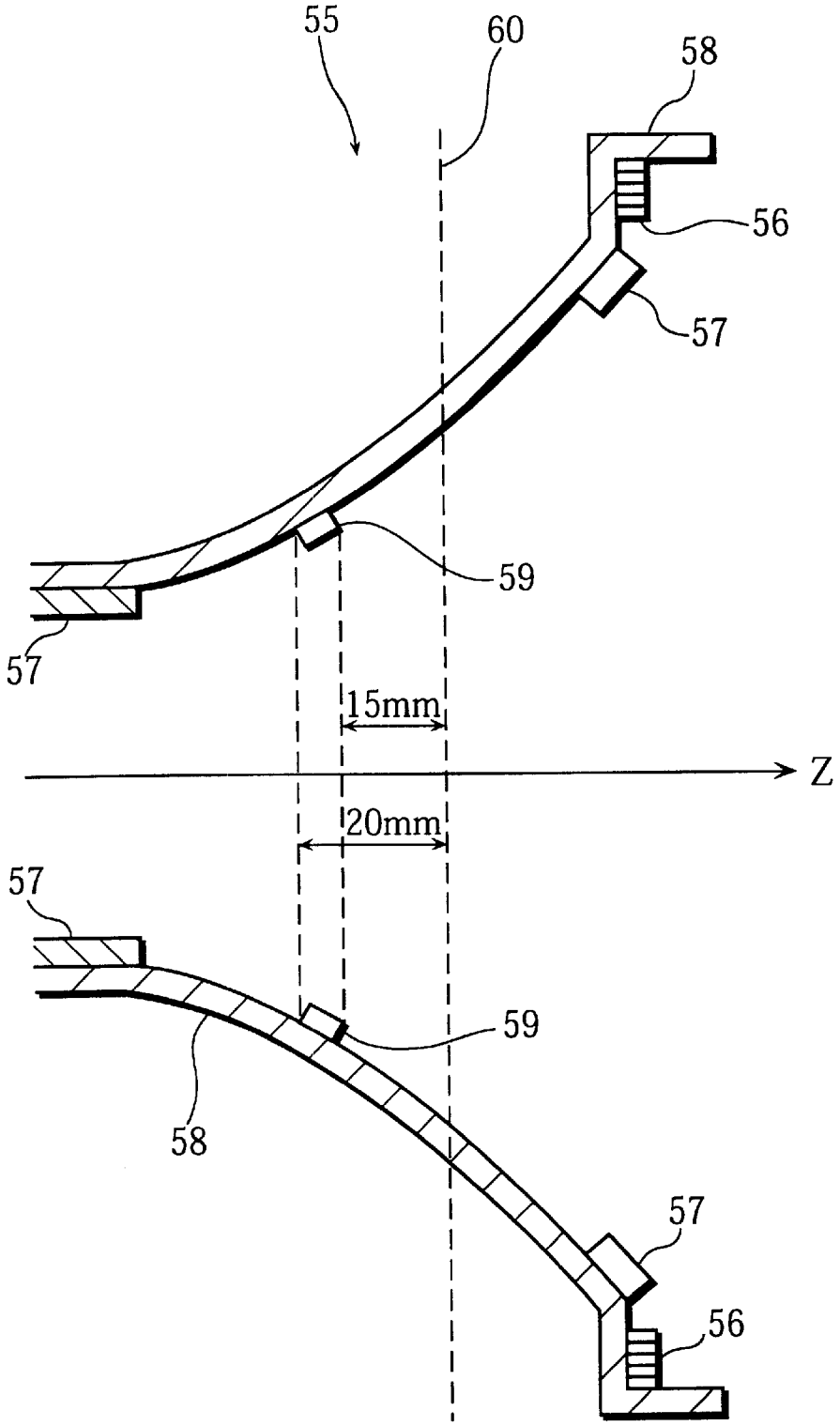
FIG. 25 is a vertical cross-section of a deflection yoke 55 including a tube axis Z.

The structure of a monitor in the second embodiment is the same as that of the monitor in the first embodiment, apart from the structure of the vertical deflection yoke and the addition of the permalloy. In the first embodiment, the vertical deflection yoke is divided into outer and inner coils, but in the second embodiment, it is formed from just two coils: an east coil E and a west coil W. The permalloy is 5.0 mm by 25.0 mm in size and is attached to the inner surface of the deflection yoke at a position between 15.0 mm and 20.0 mm from on the electron gun side of a reference line. FIG. 24 is a view of a deflection yoke 55 in the monitor of the second embodiment, as seen from in front of the display screen. The deflection yoke 55 has magnets 56 attached to the upper and lower edges of an insulating frame 58, and permalloys 59 are attached to parts of the insulating frame 58 exposed by openings formed in a horizontal deflection coil 57. FIG. 25 is a vertical cross-section of the deflection yoke 55, including a tube axis Z. Permalloys 59 are attached to the surface of the insulating frame 58 at a position between 15.0 mm and 20.0 mm from a reference line 60, on the side of the reference line 60 nearer to the electron gun side. The reference line 60 is perpendicular to the tube axis Z, and is a straight line including a deflection center. The barrel distortion of the vertical deflection field is strengthened by the permalloys 59, enabling misconvergence to be corrected in a similar way to the first embodiment.

Note that the permalloys 59 need only be positioned so as to be nearer to the outer surface of the glass tube than is the vertical deflection coil, and may be, for example, arranged between the insulating frame and the vertical deflection coil. Furthermore, a magnetic substance other than permalloy may be used to achieve the above effects, provided that it is normally or strongly magnetic.

The invention has been described with reference to the above embodiments, but need not be limited to the structures described therein. The following modifications may also be employed.

Modifications

The barrel distortion of the vertical deflection field can be strengthened by adjusting the winding distribution of the vertical deflection coil. In other words, if coil sections with a large winding angle have a smaller number of turns than coil sections with a small winding angle, the barrel distortion of the vertical deflection field can be strengthened.

Figure 26:
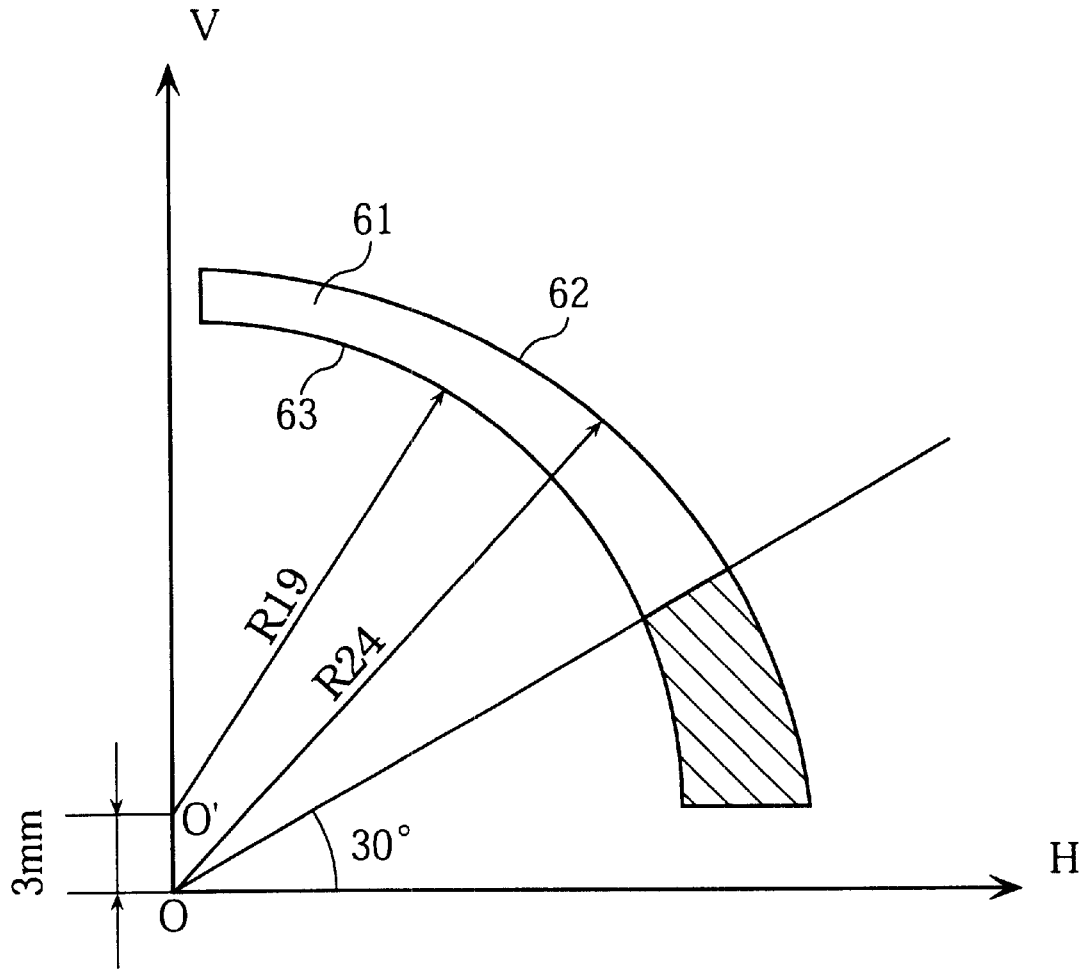
FIG. 26 is a cross-sectional enlargement of a first quadrant in a cross-section of a plane perpendicular to the tube axis Z of the-vertical deflection coil.

FIG. 26 is an enlargement of a first quadrant in a cross-section of a plane perpendicular to the tube axis Z of the vertical deflection coil. A section 61 of the vertical deflection coil is in an area between an arc 62 having a radius 24.0 mm from the origin O, and an arc 63 having a radius 19.0 mm from a point O', the point O' found by moving 3 mm in the positive direction along the vertical axis V from the origin O. The part of section 61 with a winding angle of 30° or less (the shaded area in the drawing) is particularly wide. The number of turns wound around the vertical deflection coil totals 98, and these are distributed in proportion to the width of the cross-section 61. The second, third and fourth quadrants of the vertical deflection coil have a shape symmetrical to that of the first quadrant.

If winding distribution is performed in this way, the number of turns in the area with a small winding angle is increased, thereby strengthening the barrel distortion of the vertical deflection field. As a result, if a four-pole coil and coma correction coil with the above characteristics are used together, the effects of the present invention can be obtained.

Furthermore, the embodiments are described with reference to a 19 inch monitor with a deflection angle of 100°, and a virtually flat screen with a 4:3 aspect ratio, but a monitor having a different screen size, deflection angle, aspect ratio or screen curvature may be corrected using the structure of this invention, provided that the misconvergence experienced by such a monitor can be ascribed to magnets.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A color cathode ray tube (CRT) using a self-convergence method, and having magnets for correcting top/bottom pincushion distortion, the CRT comprising:

a vertical deflection coil for generating a first correction field distorted in a barrel shape, and a four-pole coil, arranged on a side of a deflection yoke nearer to an electron gun, for generating a second correction field to correct YH barrel pattern misconvergence, a strength of the second correction field varying according to an amount of vertical deflection applied to electron beams emitted by the electron gun.

2. The CRT of claim 1, wherein:

the vertical deflection coil includes a first coil part and a second coil part connected in series, the first coil part having coil sections with a larger winding angle than a winding angle of coil sections in the second coil part, the first and second coil parts are connected in parallel respectively to first and second impedance elements, and the first correction field is distorted in the barrel shape by making an impedance of the second impedance element larger than an impedance of the first impedance element.

3. The CRT of claim 1, wherein:

the vertical deflection coil includes a first coil part and a second coil part connected in series, the first coil part having coil sections with a larger winding.angle than a winding angle of coil sections in the second coil part, and the first correction field is distorted in the barrel shape by having a greater number of turns in the second coil part than in the first coil part.

4. The CRT of claim 1, wherein:

three horizontally aligned electron beams are emitted by the electron gun, the second correction field is generated by the four-pole coil so as to apply an inward horizontal force to each outer electron beam of the three horizontally aligned electron beams, the strength of the second correction field applied to the electron beams is at a maximum when the amount of vertical deflection applied to the electron beams is at a maximum, and at a minimum when the amount of vertical deflection experienced by the electron beams is zero.

5. The CRT of claim 4, wherein:

the four-pole coil is connected to the vertical deflection coil via a peripheral circuit, the peripheral circuit including (1) a series circuit in which two resistors are connected in series, (2) two diodes each having a cathode connected respectively to either end of the series circuit, and (3) two variable resistors, each connected respectively to an anode of one of the two diodes at one end, and to one end of the four-pole coil at the other end, the other end of the four-pole coil is connected to a node at which the two resistors in the series circuit are connected, and the series circuit is connected in series to the vertical deflection coil.

6. The CRT of claim 5, wherein:

the four-pole coil includes two coils connected in series, each of the two coils is wound around one of two U-shaped cores, the u-shaped cores are arranged with corresponding ends in opposition, and the electron beams pass between the opposed U-shaped cores.

7. The CRT of claim 1 further comprises a coma correction coil, arranged on the side of the deflection yoke nearer to the electron gun, for generating a third correction field to correct vertical coma residual (VCR) misconvergence, wherein a strength of the third correction field varies according to the amount of vertical deflection applied to the electron beams.

8. The CRT of claim 7, wherein:

the force applied to the electron beams by the third correction field is applied in a same orientation as the vertical deflection, the forces applied to the outer electron beams are of equal strength, while a force applied to a central electron beam is greater than the forces applied to the outer electron beams, and the strength of the third correction field applied to the electron beams is at a maximum when the amount of vertical deflection applied to the electron beams is at a maximum, and at a minimum when the amount of vertical deflection experienced by the electron beams is zero.

9. The CRT of claim 8, wherein the coma correction coil includes two coils that are connected in series, and connected in series to the vertical deflection coil, each of the two coils is wound around one of two U-shaped cores, the two U-shaped cores are arranged in opposition, and the electron beams pass between the two opposed U-shaped cores.

10. A color cathode ray tube (CRT) using a self-convergence method, and having magnets for correcting top/bottom pincushion distortion, the CRT comprising:

a magnetic substance, being one of a normally magnetic substance and a strongly magnetic substance, that is arranged on the side of the vertical deflection coil nearer to an outer surface of a glass tube to distort a vertical deflection field in a barrel shape; and a four-pole coil, arranged on a side of a deflection yoke nearer to an electron gun, for correcting YH barrel pattern misconvergence by generating a second correction field, a strength of the second correction field varying according to an amount of vertical deflection applied to electron beams emitted by the electron gun.

11. The CRT of claim 10, wherein three horizontally aligned electron beams are emitted by the electron gun, the second correction field is generated by the four-pole coil so as to apply an inward horizontal force to each outer electron beam of the three horizontally aligned electron beams, the strength of the second correction field applied to the electron beams is at a maximum when the amount of vertical deflection applied to the electron beams is at a maximum, and at a minimum when the amount of vertical deflection experienced by the electron beams is zero.

12. The CRT of claim 11, wherein the four-pole coil is connected to the vertical deflection coil via a peripheral circuit, the peripheral circuit including (1) a series circuit in which two resistors are connected in series, (2) two diodes each having a cathode connected respectively to either end of the series circuit, and (3) two variable resistors, each connected respectively to an anode of one of the two diodes at one end, and to one end of the four-pole coil at the other end, the other end of the four-pole coil is connected to a node at which the two resistors in the series circuit are connected, and the series circuit is connected in series to the vertical deflection coil.

13. The CRT of claim 12, wherein the four-pole coil includes two coils connected in series, each of the two coils is wound around on e of two U-shaped cores, the U-shaped c ores are arranged with corresponding ends in opposition, and the electron beams pass between the opposed U-shaped cores.

14. The CRT of claim 10 further comprises a coma correction coil, arranged on the side of the deflection yoke nearer to the electron gun, for generating a third correction field to correct vertical coma residual (VCR) misconvergence, wherein a strength of the third correct ion field varies according to the amount of vertical deflection applied to the electron beams.

15. The CRT of claim 14, wherein the force applied to the electron beams by the third correction field is applied in a same orientation as the vertical deflection, the forces applied to the outer electron beams are of equal strength, while a force applied to a central electron beam is greater than the forces applied to the outer electron beams, and the strength of the third correction field applied to the electron beams is at a maximum when the amount of vertical deflection applied to the electron beams is at a maximum, and at a minimum when the amount of vertical deflection experienced by the electron beams is zero.

16. The CRT of claim 15, wherein the coma correction coil includes two coils that are connected in series, and connected in series to the vertical deflection coil, each of the two coils is wound around one of two U-shaped cores, the two U-shaped cores are arranged in opposition, and the electron beams pass between the two opposed U-shaped cores.

17. In a color cathode ray tube having a display screen, a vertical deflection field unit, a horizontal deflection field unit, an electron gun unit for generating R, G, and B electron beams, a first magnet member mounted adjacent to the top of the display screen and a second magnet member mounted adjacent to the bottom of the display screen, the first and second magnet members provide respective fixed magnetic fields for addressing the correction of top/bottom pincushion distortion, the improvement of:

a vertical deflection coil for generating a first correction field distorted in a barrel shape;

a four-pole coil, arranged adjacent to the electron gun unit that generates R, G and B electron beams; and means for driving the four-pole coil for generating a variable second correction field to correct YH barrel pattern misconvergence, a strength of the second correction field varying according to the amount of vertical deflection applied to the R, G, and B electron beams to balance the YH barrel pattern misconvergence.

18. The color cathode ray tube of claim 17 wherein the means for driving the four-pole coil generates the variable second correction field to have a maximum strength applied to the R, G, and B electron beams when the amount of vertical deflection applied to the R, G, and B electron beams is at a maximum and to have a minimum strength when the amount of vertical deflection applied to the R, G, and B electron beams is at a minimum.

19. The color cathode ray tube of claim 18 wherein the four-pole coil is connected to the vertical deflection coil via a peripheral circuit, the peripheral circuit including (1) a series circuit in which two resistors are connected in series, (2) two diodes each having a cathode connected respectively to either end of the series circuit, and (3) two variable resistors, each connected respectively to an anode of one of the two diodes at one end, and to one end of the four-pole coil at the other end, the other end of the four-pole coil is connected to a node at which the two resistors in the series circuit are connected, and the series circuit is connected in series to the vertical deflection coil.

20. The color cathode ray tube of claim 18 further including a coma correction coil unit that includes two coils connected in series to the vertical deflection coil, the four-pole coil includes two coils connected in series and a pair of E-shaped cores arranged with corresponding ends in opposition with the election beams passing between the opposed E-shaped cores, the coma correction coil unit and the four-pole coil share the same E-shaped cores.

* * * * *